US006979480B1

(12) United States Patent
Schulz et al.

(10) Patent No.: US 6,979,480 B1
(45) Date of Patent: Dec. 27, 2005

(54) POROUS INKJET RECEPTOR MEDIA

(75) Inventors: Mark F. Schulz, Lake Elmo, MN (US); David W. Tweeten, Oakdale, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 339 days.

(21) Appl. No.: 09/591,075

(22) Filed: Jun. 9, 2000

(51) Int. Cl.[7] ..... B41M 5/40

(52) U.S. Cl. ..... 428/32.17; 428/32.28; 428/32.35; 428/32.37

(58) Field of Search ..... 428/143, 147, 428/323, 327, 500, 522, 195, 211, 32.17, 32.28, 32.35, 32.37, 32.38

(56) References Cited

U.S. PATENT DOCUMENTS

| | | | | |
|---|---|---|---|---|
| 4,048,271 | A | 9/1977 | Kesting | 264/41 |
| 4,090,662 | A | 5/1978 | Fayling | 235/493 |
| 4,247,498 | A | 1/1981 | Castro | 264/41 |
| 4,371,582 | A | 2/1983 | Sugiyama et al. | 428/341 |
| 4,384,047 | A | 5/1983 | Benzinger et al. | 521/64 |
| 4,396,643 | A | 8/1983 | Kuehn et al. | 427/160 |
| 4,419,388 | A | 12/1983 | Sugiyama et al. | 427/288 |
| 4,429,015 | A | 1/1984 | Sheptak | 428/201 |
| 4,442,172 | A | 4/1984 | Oshima et al. | 428/342 |
| 4,451,582 | A | 5/1984 | Denzinger et al. | 521/38 |
| 4,452,843 | A | 6/1984 | Kaule et al. | 428/199 |
| 4,460,637 | A | 7/1984 | Miyamoto et al. | 428/212 |
| 4,496,629 | A | 1/1985 | Haruta et al. | 428/341 |
| 4,503,111 | A | 3/1985 | Jaeger et al. | 428/195 |
| 4,539,256 | A | 9/1985 | Shipman | 428/315.5 |
| 4,613,441 | A | 9/1986 | Kohno et al. | 210/500.36 |
| 4,630,891 | A | 12/1986 | Li | 350/105 |
| 4,649,064 | A | 3/1987 | Jones | 427/256 |
| 4,701,837 | A | 10/1987 | Sakaki et al. | 346/135.1 |
| 4,726,989 | A | 2/1988 | Mrozinski | 428/315.5 |
| 4,732,786 | A | 3/1988 | Patterson et al. | 427/261 |
| 4,749,084 | A | 6/1988 | Pereyra | 206/459 |
| 4,775,594 | A | 10/1988 | Desjarlais | 428/421 |
| 4,781,985 | A | 11/1988 | Desjarlais | 428/421 |
| 4,812,352 | A | 3/1989 | Debe | 428/142 |
| 4,830,902 | A | 5/1989 | Plantenga et al. | 428/207 |
| 4,833,172 | A | 5/1989 | Schwarz et al. | 521/62 |
| 4,861,644 | A | 8/1989 | Young et al. | 428/195 |
| 4,867,881 | A | 9/1989 | Kinzer | 210/490 |
| 4,892,779 | A | 1/1990 | Leatherman et al. | 428/220 |
| 4,900,620 | A | 2/1990 | Tokita et al. | 428/330 |
| 4,930,814 | A | 6/1990 | Nusmeier | 283/109 |
| 4,935,307 | A | 6/1990 | Iqbal et al. | 428/500 |
| 4,954,395 | A | 9/1990 | Hasegawa et al. | 428/318.4 |
| 4,966,804 | A | * 10/1990 | Hasegawa et al. | 428/203 |
| 4,968,063 | A | 11/1990 | McConville et al. | 283/72 |
| 4,986,868 | A | 1/1991 | Schmidt | 156/249 |
| 5,060,981 | A | 10/1991 | Fossum et al. | 283/109 |
| 5,068,140 | A | 11/1991 | Malhotra et al. | 428/216 |
| 5,084,340 | A | 1/1992 | Light | 428/327 |
| 5,102,731 | A | 4/1992 | Takimoto et al. | 428/323 |
| 5,118,570 | A | 6/1992 | Malhotra | 428/474.4 |
| 5,120,594 | A | 6/1992 | Mrozinski | 428/195 |
| 5,126,195 | A | 6/1992 | Light | 428/327 |
| 5,134,198 | A | 7/1992 | Stofko, Jr. et al. | 525/205 |
| 5,139,598 | A | 8/1992 | Chou et al. | 156/234 |
| 5,141,797 | A | 8/1992 | Wheeler | 428/195 |
| 5,192,617 | A | 3/1993 | Stofko, Jr. et al. | 428/411.1 |
| 5,198,306 | A | 3/1993 | Kruse | 428/481 |
| 5,206,071 | A | 4/1993 | Atherton et al. | 428/195 |
| 5,208,092 | A | 5/1993 | Iqbal | 428/195 |
| 5,219,928 | A | 6/1993 | Stofko, Jr. et al. | 525/57 |
| 5,241,006 | A | 8/1993 | Iqbal et al. | 525/196 |
| 5,277,811 | A | 1/1994 | Moya | 210/500.3 |
| 5,302,436 | A | 4/1994 | Miller | 428/195 |
| 5,302,437 | A | 4/1994 | Idei et al. | 428/195 |
| 5,326,619 | A | 7/1994 | Dower et al. | 428/164 |
| 5,336,558 | A | 8/1994 | Debe | 428/323 |

(Continued)

FOREIGN PATENT DOCUMENTS

| | | | |
|---|---|---|---|
| DE | 67895 | * | 3/1979 |
| DE | 30 24 205 | A1 | 1/1982 |
| EP | 0 233 703 | A2 | 8/1987 |
| EP | 0 380 133 | A1 | 1/1990 |
| EP | 0 484 016 | A1 | 5/1992 |
| EP | 0 716 931 | A1 | 6/1996 |
| EP | 0 718 384 | A2 | 6/1996 |
| EP | 0 802 245 | A1 | 10/1997 |
| EP | 0 904 953 | A1 | 3/1999 |
| JP | 61-41585 | | 2/1986 |
| JP | 61-261089 | | 11/1986 |
| JP | 11-296658 | | 10/1999 |
| WO | WO 88/06532 | | 9/1988 |
| WO | WO 92/07722 | | 5/1992 |
| WO | WO 93/01938 | | 2/1993 |
| WO | WO 97/15457 | | 5/1997 |
| WO | WO 98/05512 | | 2/1998 |
| WO | WO 98/29516 | | 7/1998 |
| WO | WO 99/10184 | | 3/1999 |
| WO | WO 99/45375 | | 9/1999 |
| WO | WO 99/55537 | | 11/1999 |
| WO | WO 00/00352 | | 1/2000 |

OTHER PUBLICATIONS

Tyvek Product Bulletin, obtained from Dupont Tyvek Website, http://www.tyvek.com. Visited Nov. 2001.*

Luvicross Product Bulletin (1999), retrieved from BASF website (www.basf.com), site visited Jun. 23, 2002.*

*Primary Examiner*—B. Shewareged
(74) *Attorney, Agent, or Firm*—Scott A. Bardell

(57) ABSTRACT

Improved macroporous ink receptor media are disclosed. An inkjet receptive media in accordance with one embodiment of the present invention comprises a web comprising a plurality of fibers and a coating overlaying at least a portion of a plurality of the fibers. In a preferred embodiment, the coating comprises a plurality of organic particles. In a preferred embodiment, the fibers define a plurality of pores. In a preferred embodiment, the web defines a plurality of macropores. The fibers of the web may be woven or nonwoven. In a preferred embodiment, the web comprises a nonwoven macroporous material.

26 Claims, 27 Drawing Sheets

(26 of 27 Drawing Sheet(s) Filed in Color)

U.S. PATENT DOCUMENTS

| | | | | |
|---|---|---|---|---|
| 5,342,688 | A | | 8/1994 | Kitchin et al. ..... 428/402 |
| 5,370,763 | A | | 12/1994 | Curiel ..... 156/277 |
| 5,374,475 | A | | 12/1994 | Walchli ..... 428/304.4 |
| 5,376,727 | A | | 12/1994 | Iqbal et al. ..... 525/196 |
| 5,380,044 | A | | 1/1995 | Aitkens et al. ..... 283/67 |
| 5,389,723 | A | | 2/1995 | Iqbal et al. ..... 525/57 |
| 5,410,642 | A | | 4/1995 | Hakamatsuka et al. ..... 395/113 |
| 5,422,178 | A | | 6/1995 | Swenson et al. ..... 428/343 |
| 5,429,860 | A | | 7/1995 | Held et al. ..... 428/195 |
| 5,435,599 | A | | 7/1995 | Bernecker ..... 283/70 |
| 5,443,727 | A | | 8/1995 | Gagnon ..... 210/490 |
| 5,462,708 | A | | 10/1995 | Swenson et al. ..... 264/174.11 |
| 5,464,254 | A | | 11/1995 | Campbell et al. ..... 283/109 |
| 5,472,789 | A | | 12/1995 | Iqbal et al. ..... 428/483 |
| 5,534,320 | A | | 7/1996 | Raby ..... 428/42.1 |
| 5,537,137 | A | | 7/1996 | Held et al. ..... 347/105 |
| 5,545,280 | A | | 8/1996 | Wenz ..... 156/234 |
| 5,569,529 | A | | 10/1996 | Becker et al. ..... 428/331 |
| 5,589,259 | A | | 12/1996 | Hosoi et al. ..... 428/323 |
| 5,591,527 | A | | 1/1997 | Lu ..... 428/411.1 |
| 5,595,403 | A | | 1/1997 | Garrison ..... 283/74 |
| 5,599,765 | A | | 2/1997 | Ohshima et al. ..... 503/227 |
| 5,629,093 | A | | 5/1997 | Bischof et al. ..... 428/411.1 |
| 5,658,411 | A | | 8/1997 | Faykish ..... 156/233 |
| 5,660,919 | A | | 8/1997 | Vallee et al. ..... 428/206 |
| 5,683,774 | A | | 11/1997 | Faykish et al. ..... 428/40.1 |
| 5,686,602 | A | | 11/1997 | Farooq et al. ..... 536/101 |
| 5,688,738 | A | | 11/1997 | Lu ..... 503/227 |
| 5,707,722 | A | | 1/1998 | Iqbal et al. ..... 428/304.4 |
| 5,710,588 | A | | 1/1998 | Malhotra ..... 347/153 |
| 5,712,027 | A | * | 1/1998 | Ali et al. ..... 428/212 |
| 5,721,086 | A | | 2/1998 | Emslander et al. ..... 430/126 |
| 5,747,148 | A | | 5/1998 | Warner et al. ..... 428/212 |
| 5,756,188 | A | | 5/1998 | Reiter et al. ..... 428/195 |
| 5,766,398 | A | | 6/1998 | Cahill et al. ..... 156/240 |
| 5,786,298 | A | | 7/1998 | Tsou et al. ..... 503/227 |
| 5,795,425 | A | | 8/1998 | Brault et al. ..... 156/235 |
| 5,807,461 | A | | 9/1998 | Hagstrom ..... 156/361 |
| 5,811,493 | A | | 9/1998 | Kent ..... 525/92 F |
| 5,830,561 | A | | 11/1998 | Hagner ..... 428/195 |
| 5,837,351 | A | | 11/1998 | Chernovitz et al. ..... 428/195 |
| 5,837,365 | A | | 11/1998 | Chung ..... 428/318.8 |
| 5,837,375 | A | | 11/1998 | Brault et al. ..... 428/411.1 |
| 5,846,647 | A | | 12/1998 | Yoshino et al. ..... 428/328 |
| 5,858,514 | A | | 1/1999 | Bowers ..... 428/195 |
| 5,861,230 | A | * | 1/1999 | Lambert et al. ..... 430/202 |
| 5,874,145 | A | | 2/1999 | Waller ..... 428/42.1 |
| 5,890,742 | A | | 4/1999 | Waller ..... 283/67 |
| 5,928,789 | A | | 7/1999 | Chen et al. ..... 428/413 |
| 5,939,469 | A | | 8/1999 | Fussnegger et al. ..... 523/161 |
| 5,952,104 | A | | 9/1999 | Sugiyama et al. ..... 428/409 |
| 5,958,564 | A | | 9/1999 | Iwamoto et al. ..... 428/212 |
| 5,965,256 | A | | 10/1999 | Barrera ..... 428/354 |
| 5,976,671 | A | | 11/1999 | Gleim ..... 428/172 |
| 5,989,771 | A | * | 11/1999 | Ohta et al. ..... 430/200 |
| 6,120,888 | A | * | 9/2000 | Dolsey et al. ..... 428/222 |
| 6,203,899 | B1 | * | 3/2001 | Hirose et al. ..... 428/341 |
| 6,251,512 | B1 | * | 6/2001 | Gustafson et al. ..... 428/323 |
| 6,294,592 | B1 | * | 9/2001 | Herrmann et al. ..... 522/78 |
| 6,357,871 | B1 | * | 3/2002 | Ashida et al. ..... 347/106 |
| 2001/0024713 | A1 | * | 9/2001 | Quintens et al. ..... 428/195 |

* cited by examiner

Control

POROUS INKJET RECEPTOR MEDIA

FIELD OF INVENTION

The present invention relates generally to porous materials (e.g., woven and nonwoven materials, paper, and the like). More particularly, the present invention relates to porous materials which are capable of receiving a printed image.

BACKGROUND OF THE INVENTION

Macroporous materials have demonstrated great utility in a variety of applications. Examples of applications for macroporous materials include clothing, banners, signage, greeting cards, art and craft materials, and many others.

One type of macroporous material is generally referred to as a "nonwoven". Nonwovens are omnipresent in modem life. Example of nonwovens which touch people's lives on a daily basis include surgical garments (caps, masks, and gowns), tea bags, coffee filters, vacuum cleaner bags, baby wipes, and wipers used for cleaning. Examples of wipers used for cleaning may include wipers used for washing dishes, wipers used for dusting, and wipers used for cleaning lenses (e.g., glasses and camera lenses).

Nonwovens typically comprise a plurality of fibers, which are typically arranged in a substantially randomly intertangled pattern. In some cases the fibers are simply entangled with each other to form a sheet or web. In other cases the fibers are fixed to each other by a binder material which permeates the interstitial spaces between the fibers. The fibers may also be bonded to each other without a binder.

In many applications, it is desirable to print an image onto a macroporous material. The image printed on the macroporous material may be entirely decorative or the image may be intended to communicate information. A dish cloth is one example of a macroporous article which often includes a decorative image. Each dish cloth is available with a wide variety of decorative images (e.g., plaid patterns and floral patterns). A variety of processes may be utilized to apply an image to a macroporous material.

With the advent of personal computers, and low cost, high quality inkjet printers, there has been a great deal of interest in utilizing inkjet printers to apply images to macroporous materials (e.g., paper). Some macroporous materials, however, are not suitable for inkjet printing. When this is the case, a number of printing defects may be encountered. Examples of printing defects include feathering, bleeding, blurring, splattering, banding, and mudcracking. By way of an additional example, the aqueous inks often used in conjunction with inkjet printers may be slow to dry on some substrates, increasing the likelihood that the image will be smeared while it is still wet.

SUMMARY OF THE INVENTION

The present invention is directed to porous materials coated with a composition comprising particles. When aqueous inks are deposited on a media in accordance with the present invention, an image is formed that exhibits high color density, high resolution without color bleed or feathering, rapid dry time, and good water resistance. All of these properties are achieved using compositions that contain both organic particles and inorganic particles. Some, but not all, of these attributes are achieved in a coating containing only organic particles without inorganic particles, or inorganic particles without organic particles.

An inkjet receptive media in accordance with the present invention comprises a web comprising a plurality of fibers and a coating overlaying at least a portion of a plurality of the fibers. In a preferred embodiment, the coating comprises a plurality of organic particles. In a preferred embodiment, the fibers define a plurality of pores. The pores may comprise micropores, mesopores, and/or macropores. Micropores are pores having a mean diameter less than about 5 nanometers. Mesopores are pores having a mean diameter between about 5 nanometers and about 3 $\mu$m. In a preferred embodiment, the web comprises a porous substrate.

As used herein, a "macroporous substrate" means a substrate having an average pore size of from 3 $\mu$m up to about 5 millimeters, preferably from about 10 $\mu$m up to about 2 millimeters, more preferably from about 100 $\mu$m up to about 0.5 millimeters. In addition, the macroporous substrates of the invention are characterized by having a solidity of from at least about 1 percent up to about 90 percent, preferably from at least about 5 percent up to about 70 percent, and even more preferably from at least about 10 percent up to about 50 percent. It is to be understood, that the pore sizes described above are typical values, and that a macroporous substrate may include pores with sizes lying outside these typical values.

The fibers of the web may be woven or non-woven. In a preferred embodiment, the web comprises a nonwoven macroporous material. Nonwovens typically comprise a plurality of fibers, which are typically arranged in a substantially randomly intertangled pattern. In some cases the fibers are simply entangled with each other to form a sheet or web. In other cases the fibers are fixed to each other by a binder material which permeates the interstitial spaces between the fibers. The fibers may also be bonded to each other without a binder. It should be noted that other embodiments of the web are possible without deviating from the spirit and scope of the present invention (e.g., a fabric comprising a plurality of interwoven fibers).

When a web comprising uncoated polypropylene fibers was imaged utilizing an inkjet printer, a portion of the inkjet ink penetrated through the web. When a coating in accordance with the present invention is applied to a web, it is less likely that ink will pass through the web. This is because the ink receptive coating quickly absorbs the ink; not allowing it to pool in the pores or/and or pass through the web. An inkjet ink receptive web in accordance with the present invention becomes dry to the touch rapidly when it is imaged with aqueous ink from an inkjet printer.

When an inkjet receptive web in accordance with the present invention is imaged with aqueous ink from an inkjet printer the resulting image is substantially free of printing defects. Examples of printing defects include feathering, bleeding, blurring, splattering, banding, and mudcracking.

The web may be permeable to gases (e.g., air) and vapors (e.g., water vapor) due to the presence of pores. Embodiments of the web are possible which include a plurality of apertures extending from a first major surface of the web to a second major surface of the web. For example, in some applications, the apertures may provide an increased permeability. Apertures may be formed in the web, for example, utilizing a needling process.

In a preferred method in accordance with the present invention, an ink receptive coating may be formed by applying a coating solution to the porous material. The coating solution may be prepared by dispersing alumina and crosslinked PVP particles in a solvent. Preferably the solvent comprises water, or a water/organic alcohol blend. Various methods may be utilized to apply the coating solution onto the web without deviating from the spirit and scope of the present invention. Examples of coating processes which may be suitable in some applications include spraying, dipping, slot fed knife coating, roll coating, and rotogravure coating.

The polymeric binders may be water soluble or water insoluble. Preferably, the binder is dispersed or dissolved in water, but becomes substantially cold water (about 25° C.) insoluble upon drying. Preferably, the amount of binder in the composition is less than about 60% of the total weight of the particles and the binder.

Suitable binders may be hydrophilic or hydrophobic and include natural polymers, synthetic resins, polymers and copolymers and other film forming media such as: gelatin; gum arabic; poly(vinyl alcohol); cellulose esters, such as hydroxyethyl cellulose, cellulose acetate, cellulose acetate butyrate; poly(vinyl pyrrolidone); casein; starch; poly (acrylic acid); poly(methacrylic acid); poly(vinyl chloride); polystyrenes, such as, poly(styrene-co-maleic anhydride), poly(styrene-co-acrylonitrile), and poly(styrene-co-butadiene); acrylics; polyacrylonitrile; polyvinyl acetals, such as poly(vinyl formal) and poly(vinyl butyral); polyesters; polyurethanes; phenoxy resins; poly(vinylidene chloride); polyepoxides; polycarbonates; poly(vinyl acetate); polyolefins, such as, poly(ethylene) and poly (propylene); polyamides, etc. Polyvinyl alcohols, acrylic polymers, and ethylene/vinyl acetate copolymers are preferred binders. Polyvinyl alcohols are especially preferred binders. The binders may be applied as solutions or emulsions from either aqueous or organic solvent. For aesthetic reasons, preferred binders have a glass transition temperature of from about −40° C. up to about 50° C.

Materials in accordance with the present invention are useful as aqueous ink receptive articles, especially for used with an inkjet printer, to create greeting cards, art and craft material, banners, signage, and the like. Since they are water-fast, they can be used for both indoor and outdoor applications.

BRIEF DESCRIPTION OF THE DRAWINGS

The file of this patent contains at least one drawing executed in color.

DETAILED DESCRIPTION OF THE INVENTION

The following detailed description should be read with reference to the drawings, in which like elements in different drawings are numbered in like fashion. The drawings which are not necessarily to scale, depict selected embodiments and are not intended to limit the scope of the invention. In some cases, the drawings may be highly diagrammatic in nature. Examples of constructions, materials, dimensions, and manufacturing processes are provided for various elements. Those skilled in the art will recognize that many of the examples provided have suitable alternatives which may be utilized.

FIGS. 2 through 27 were prepared by digitally scanning an imaged macroporous material. The scanned image was then printed. Each figure was prepared using the same scanning technique and the same printing technique to avoid production equipment induced differences in the color and quality of FIGS. 2 through 27.

Figure 1:
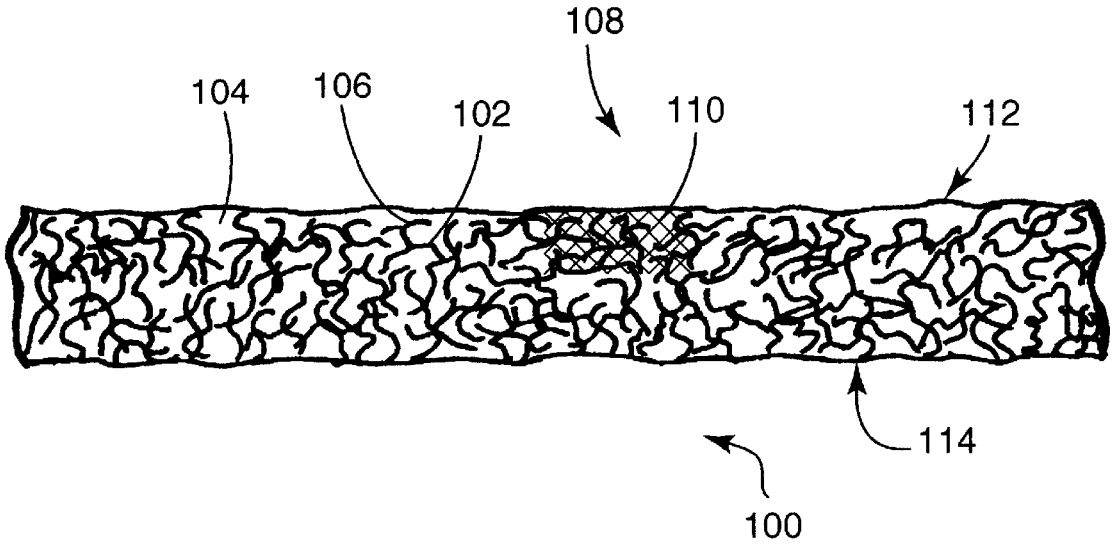
FIG. 1 is a cross sectional view of a macroporous material in accordance with an exemplary embodiment of the present invention.
Figure 2:
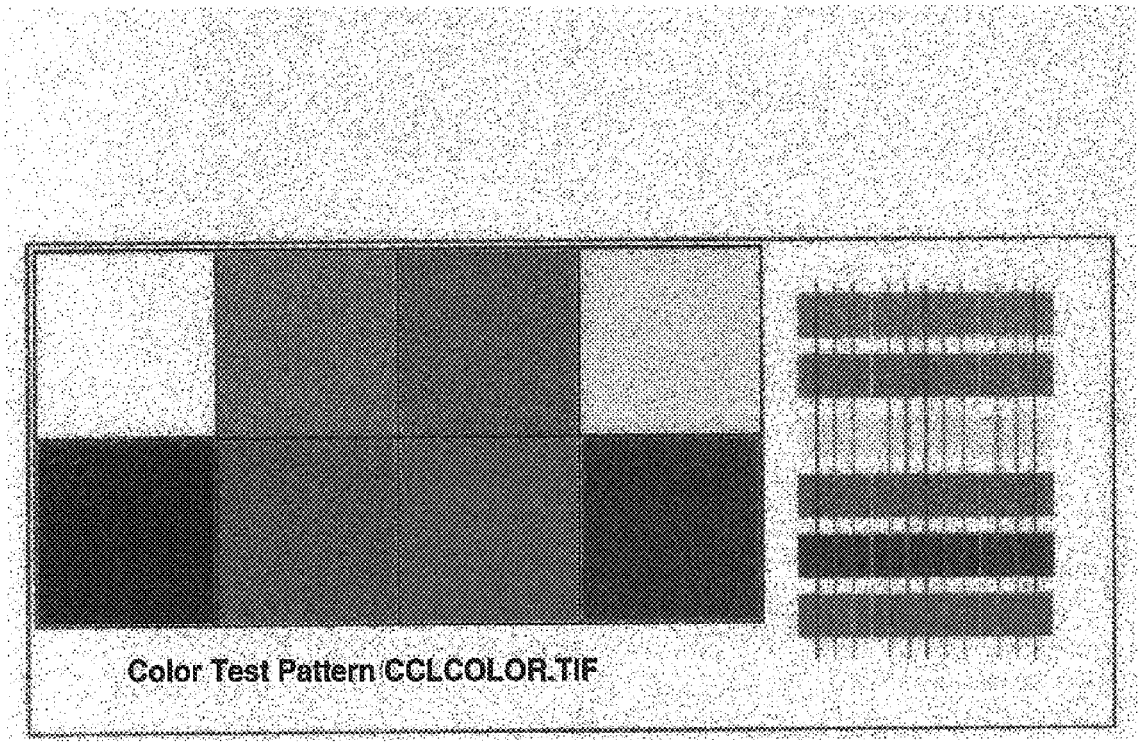
FIG. 2 is a depiction of an imaged macroporous material.
Figure 3:
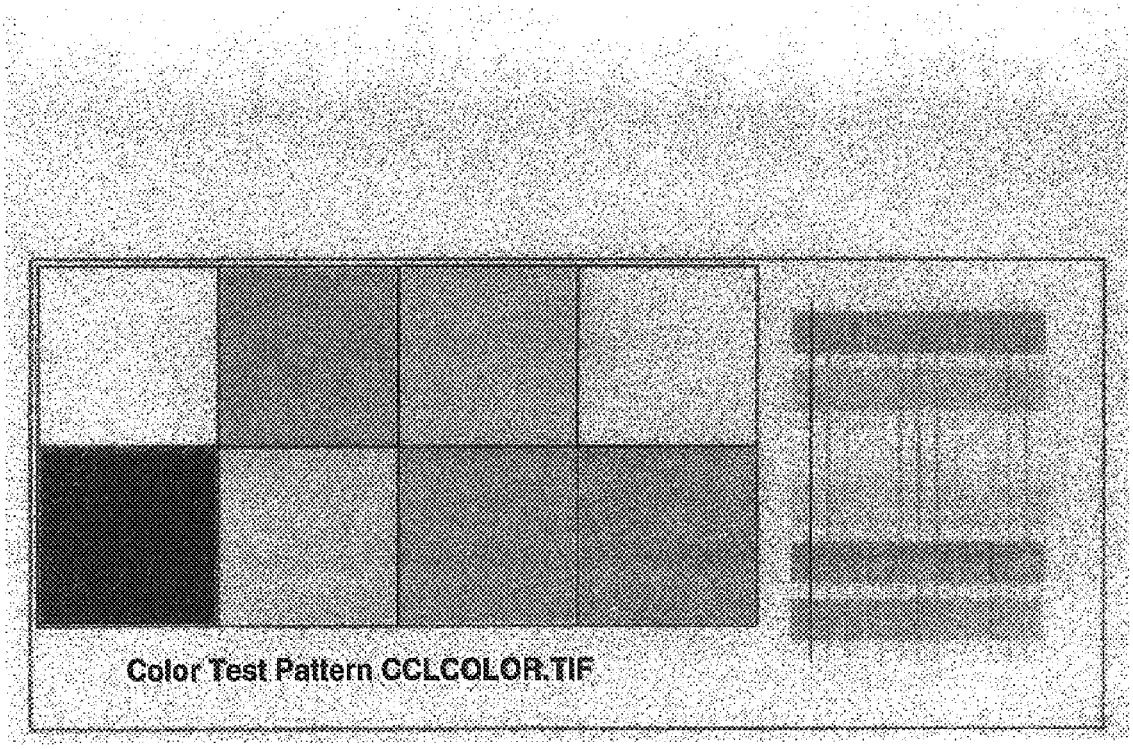
FIG. 3 is a depiction of an imaged macroporous material after soaking.
Figure 4:
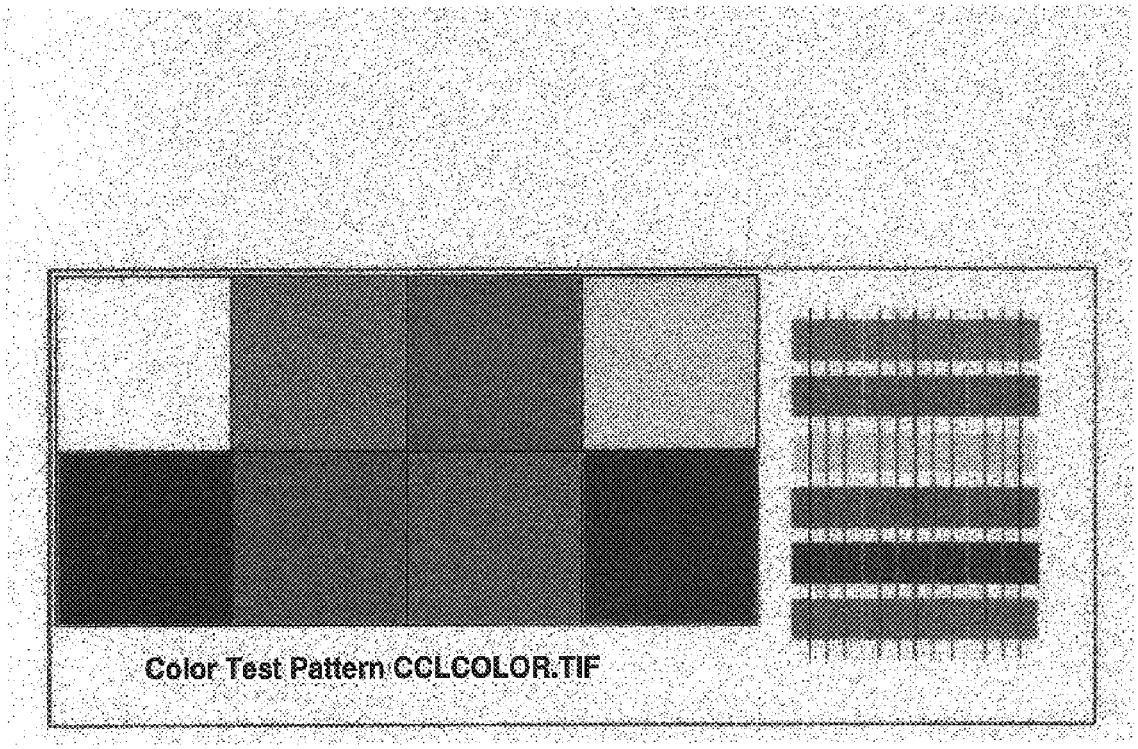
FIG. 4 is a depiction of an imaged macroporous material.
Figure 5:
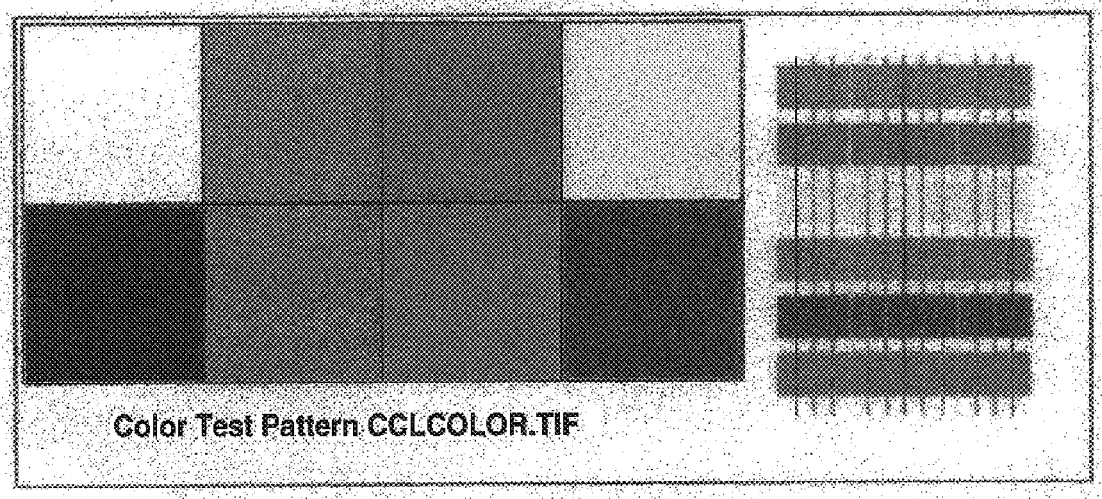
FIG. 5 is a depiction of an imaged macroporous material after soaking.
Figure 6:
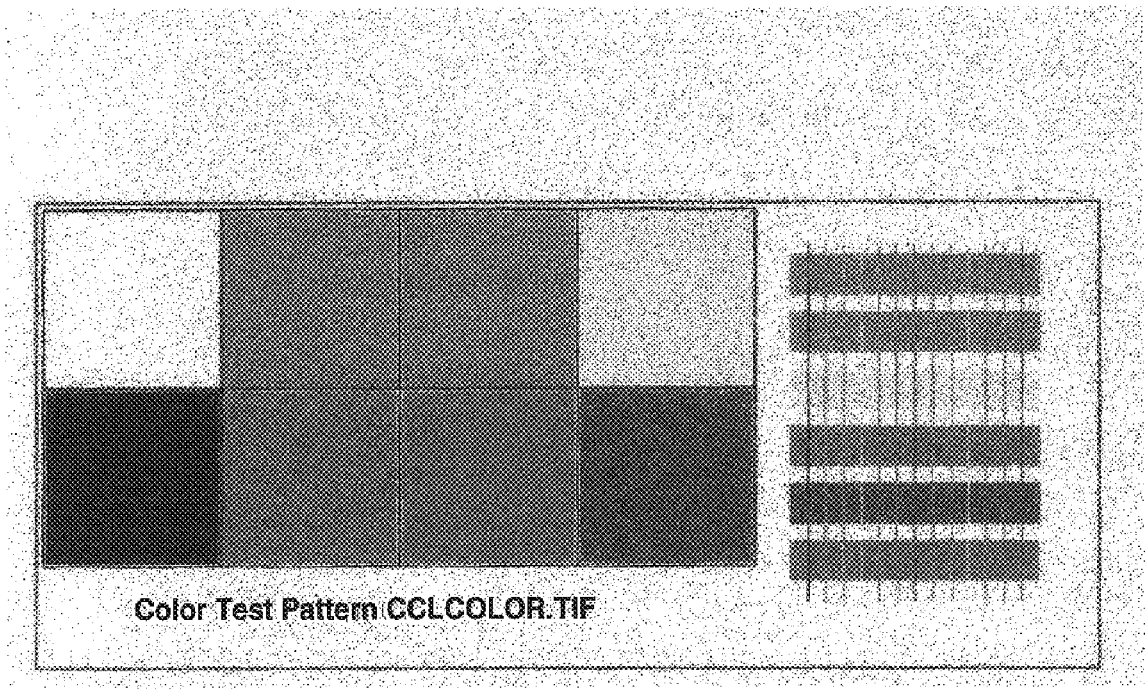
FIG. 6 is a depiction of an imaged macroporous material in accordance with an exemplary embodiment of the present invention.
Figure 7:
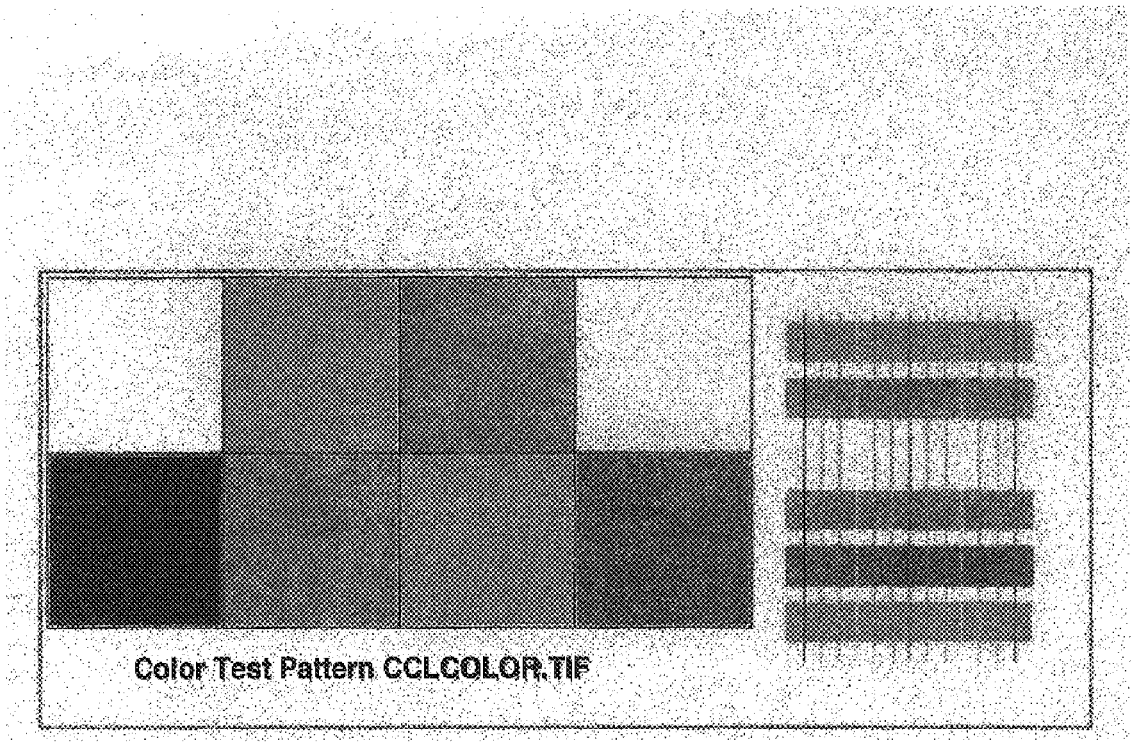
FIG. 7 is a depiction of an imaged macroporous material in accordance with an exemplary embodiment of the present invention after soaking.
Figure 8:
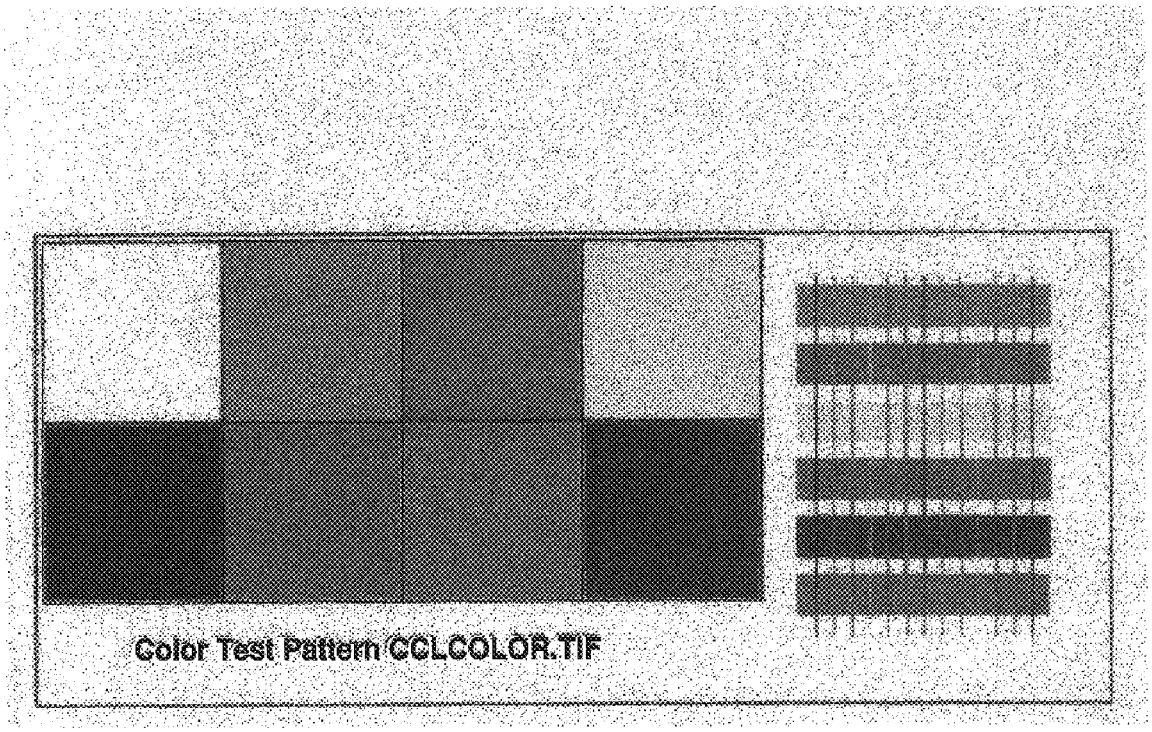
FIG. 8 is a depiction of an imaged macroporous material in accordance with an exemplary embodiment of the present invention.
Figure 9:
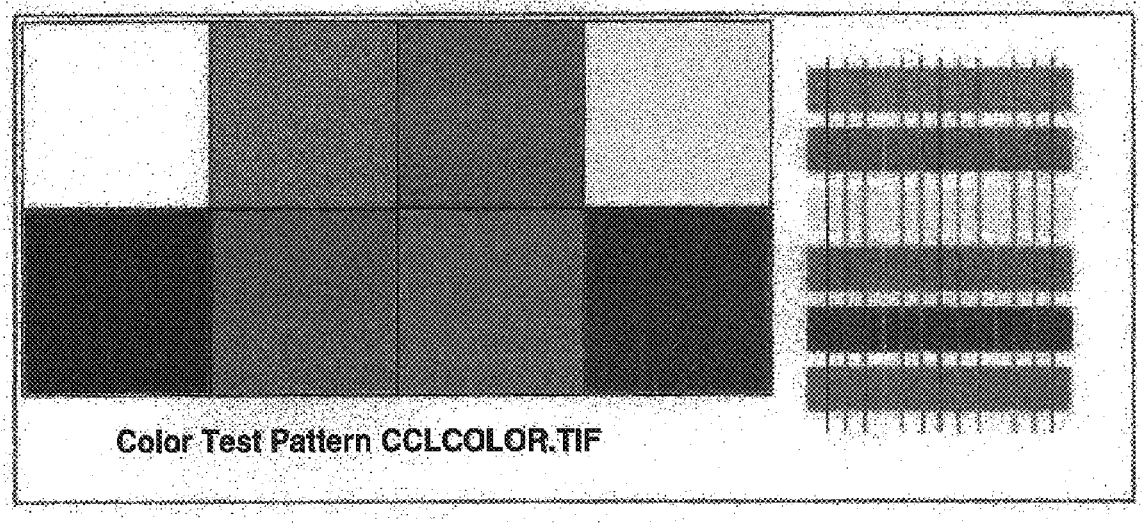
FIG. 9 is a depiction of an imaged macroporous material in accordance with an exemplary embodiment of the present invention after soaking.
Figure 10:
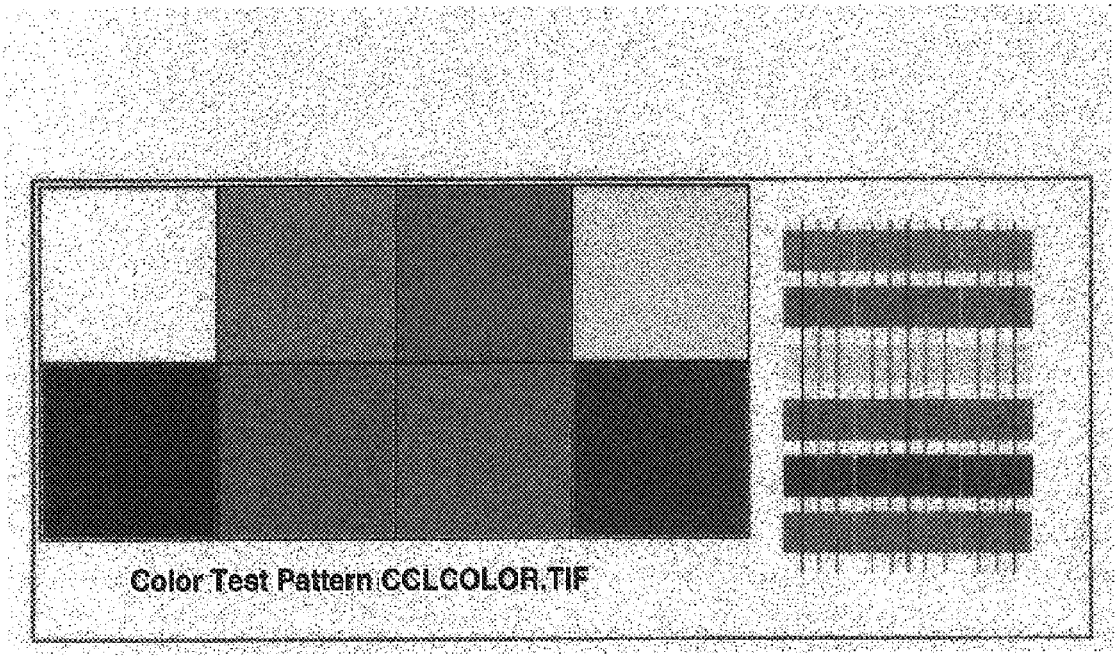
FIG. 10 is a depiction of an imaged macroporous material in accordance with an exemplary embodiment of the present invention.
Figure 11:
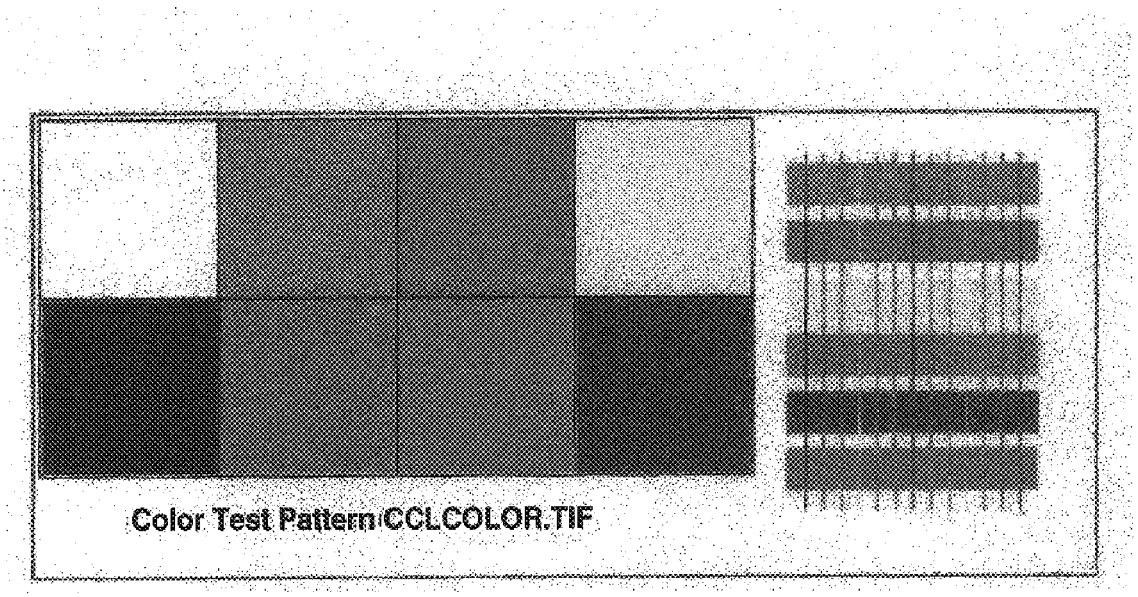
FIG. 11 is a depiction of an imaged macroporous material in accordance with an exemplary embodiment of the present invention after soaking.
Figure 12:
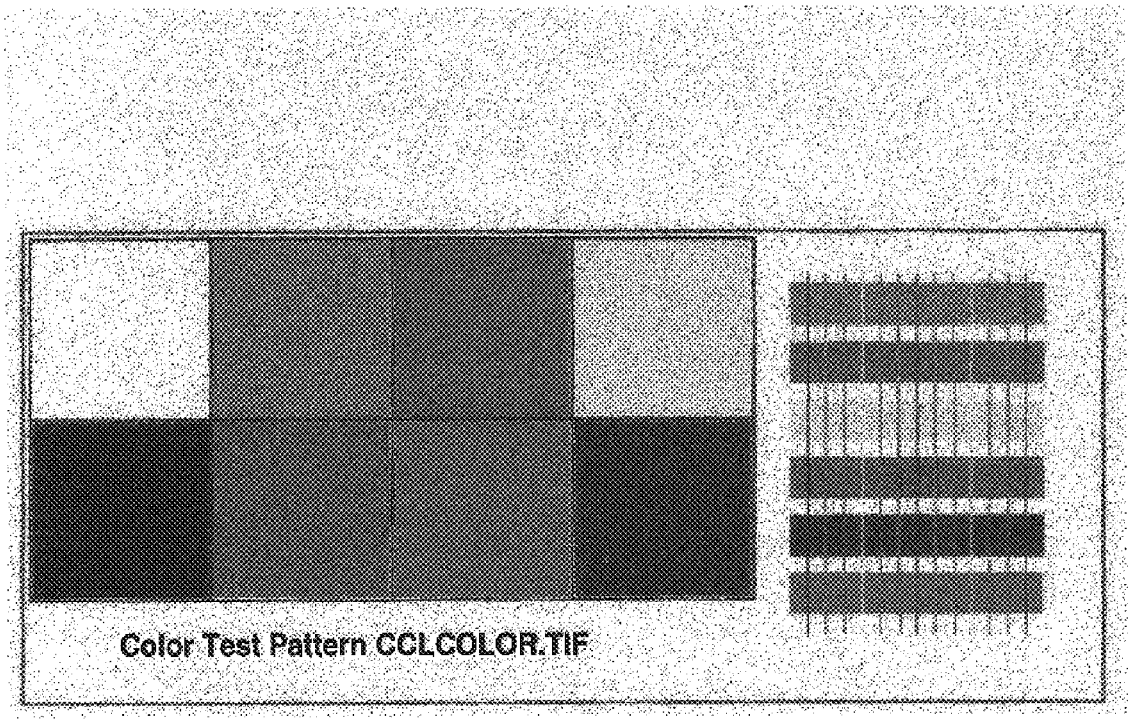
FIG. 12 is a depiction of an imaged macroporous material in accordance with an exemplary embodiment of the present invention.
Figure 13:
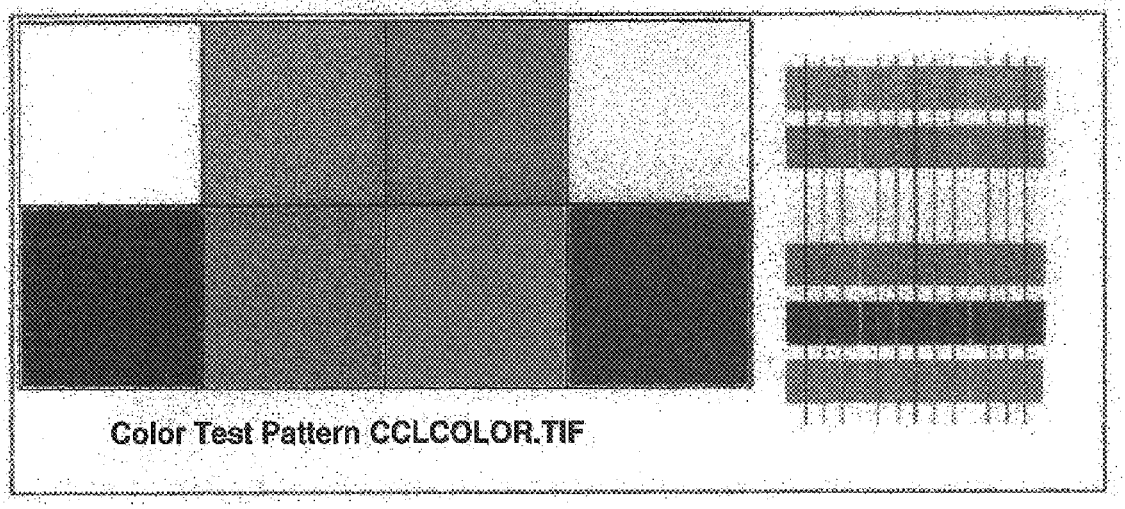
FIG. 13 is a depiction of an imaged macroporous material in accordance with an exemplary embodiment of the present invention after soaking.
Figure 14:
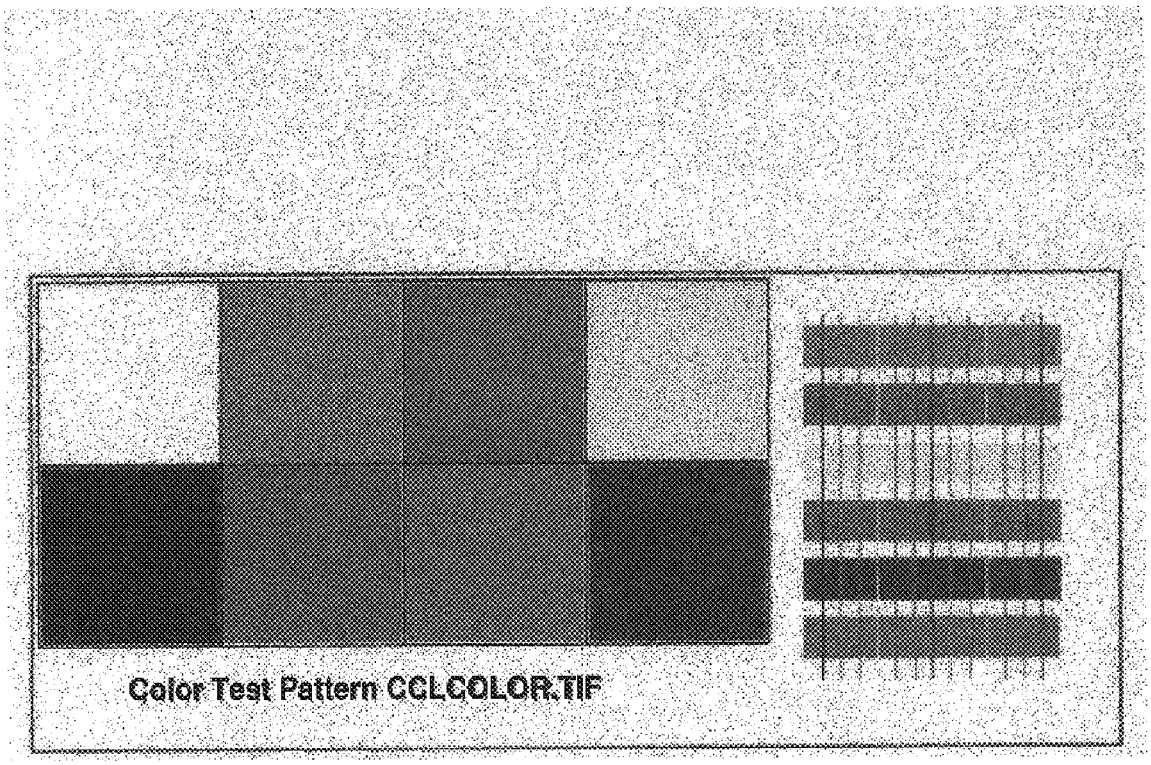
FIG. 14 is a depiction of an imaged macroporous material in accordance with an exemplary embodiment of the present invention.
Figure 15:
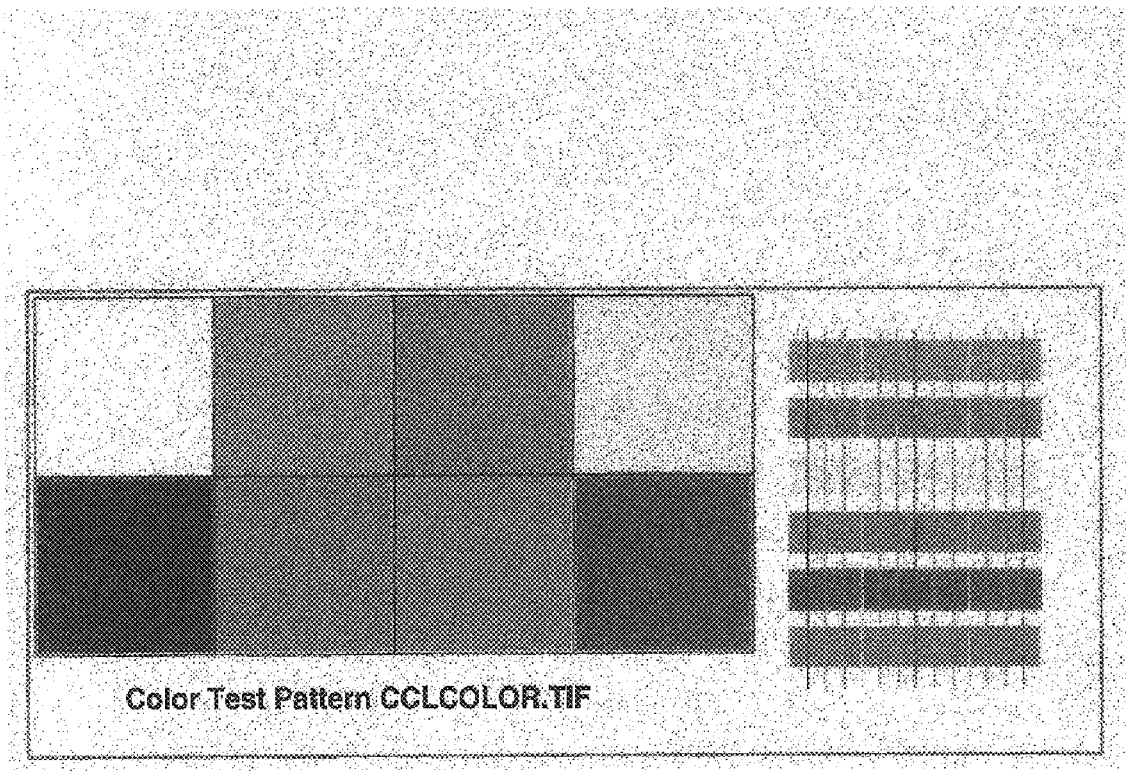
FIG. 15 is a depiction of an imaged macroporous material in accordance with an exemplary embodiment of the present invention after soaking.
Figure 16:
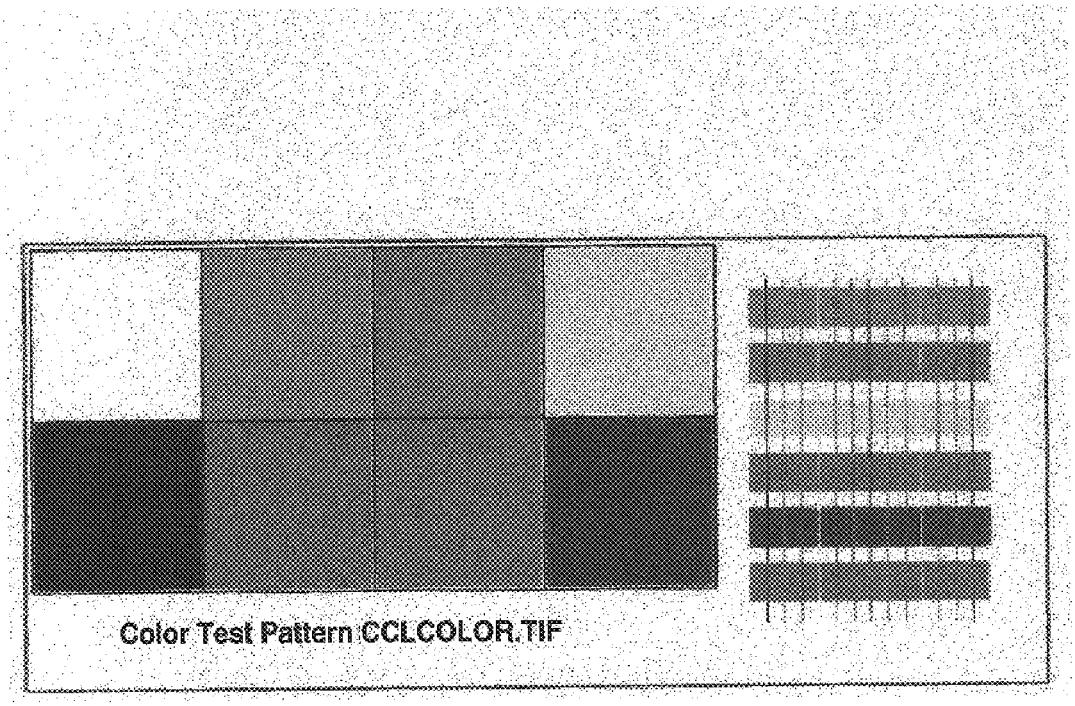
FIG. 16 is a depiction of an imaged macroporous material in accordance with an exemplary embodiment of the present invention.
Figure 17:
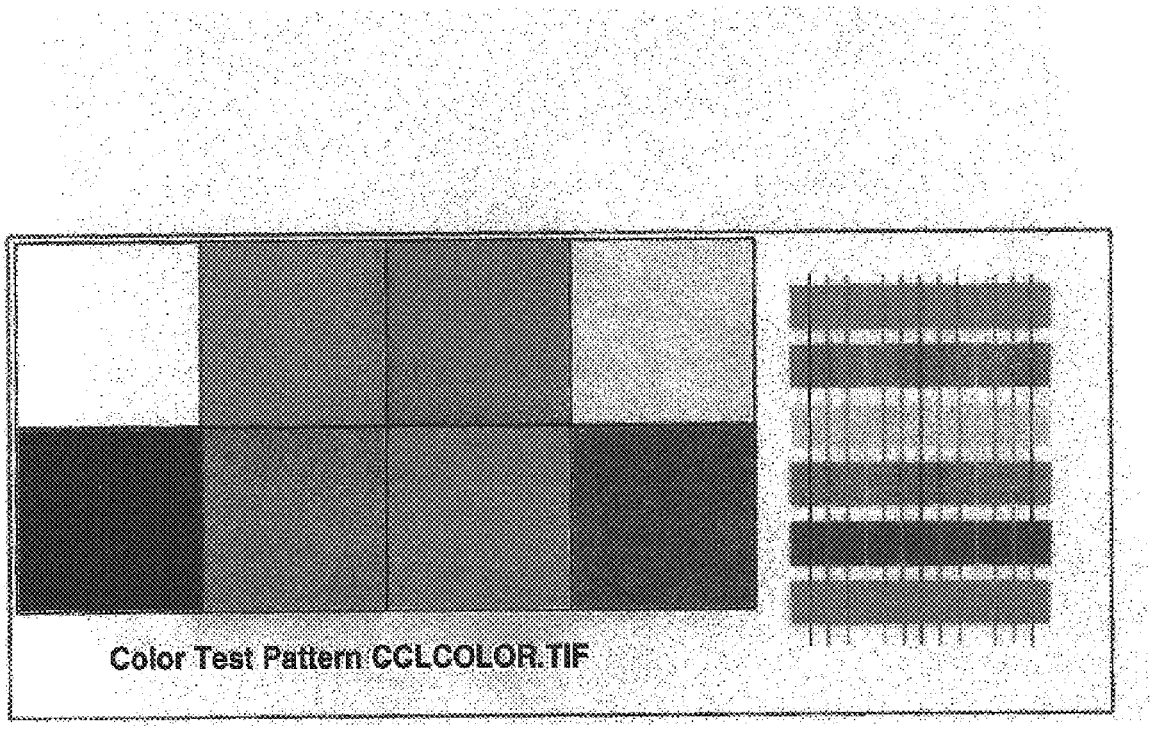
FIG. 17 is a depiction of an imaged macroporous material in accordance with an exemplary embodiment of the present invention after soaking.
Figure 18:
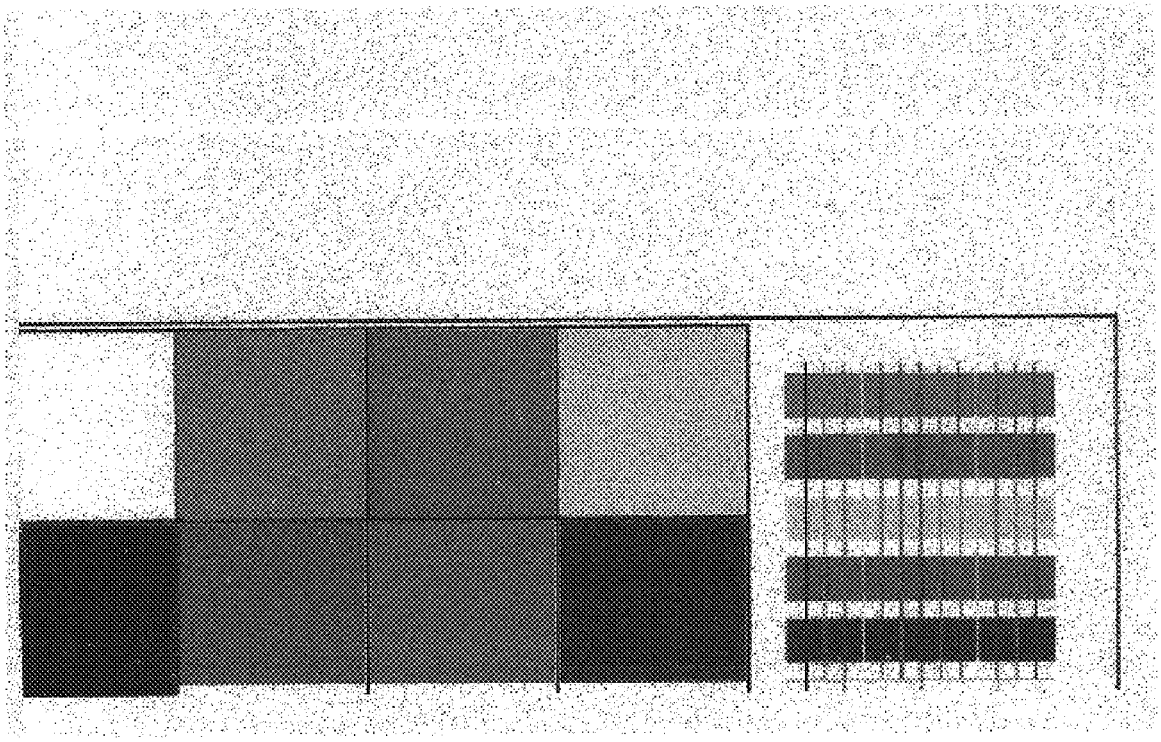
FIG. 18 is a depiction of an imaged macroporous material in accordance with an exemplary embodiment of the present invention.
Figure 19:
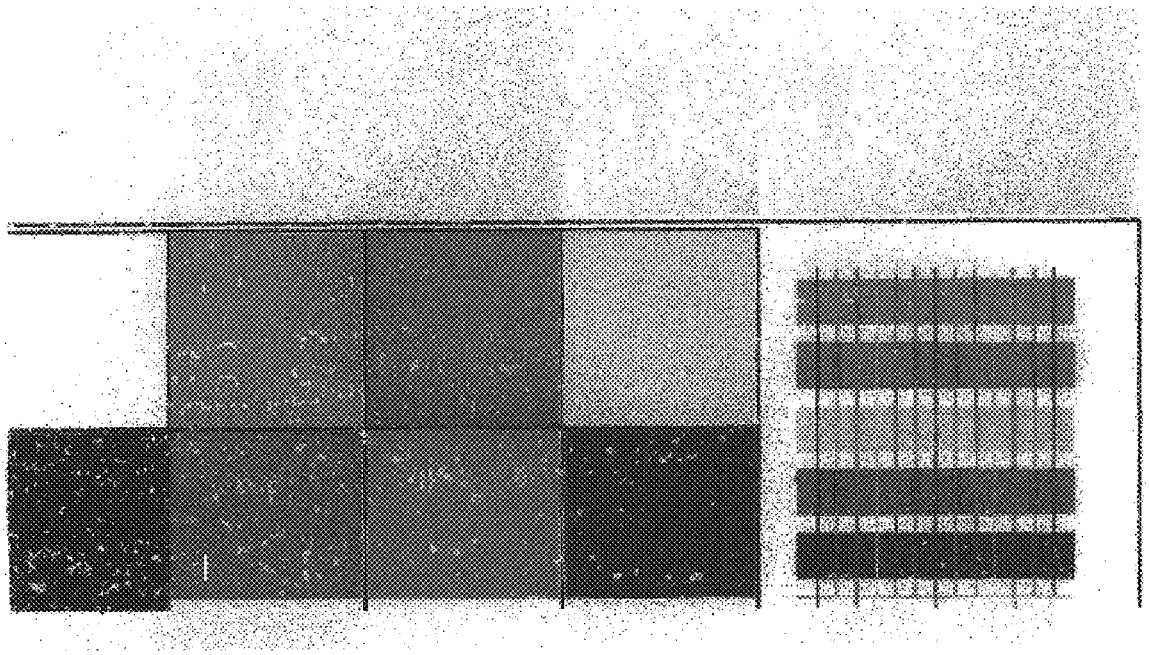
FIG. 19 is a depiction of an imaged macroporous material in accordance with an exemplary embodiment of the present invention after soaking.
Figure 20:
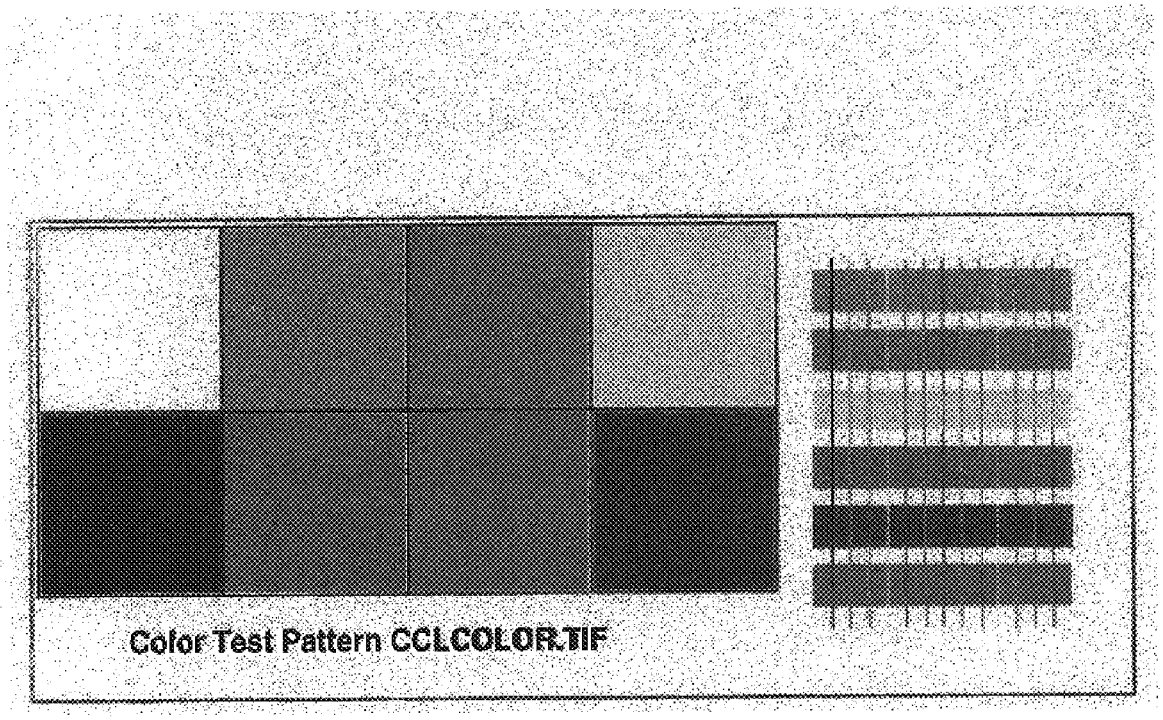
FIG. 20 is a depiction of an imaged macroporous material in accordance with an exemplary embodiment of the present invention.
Figure 21:
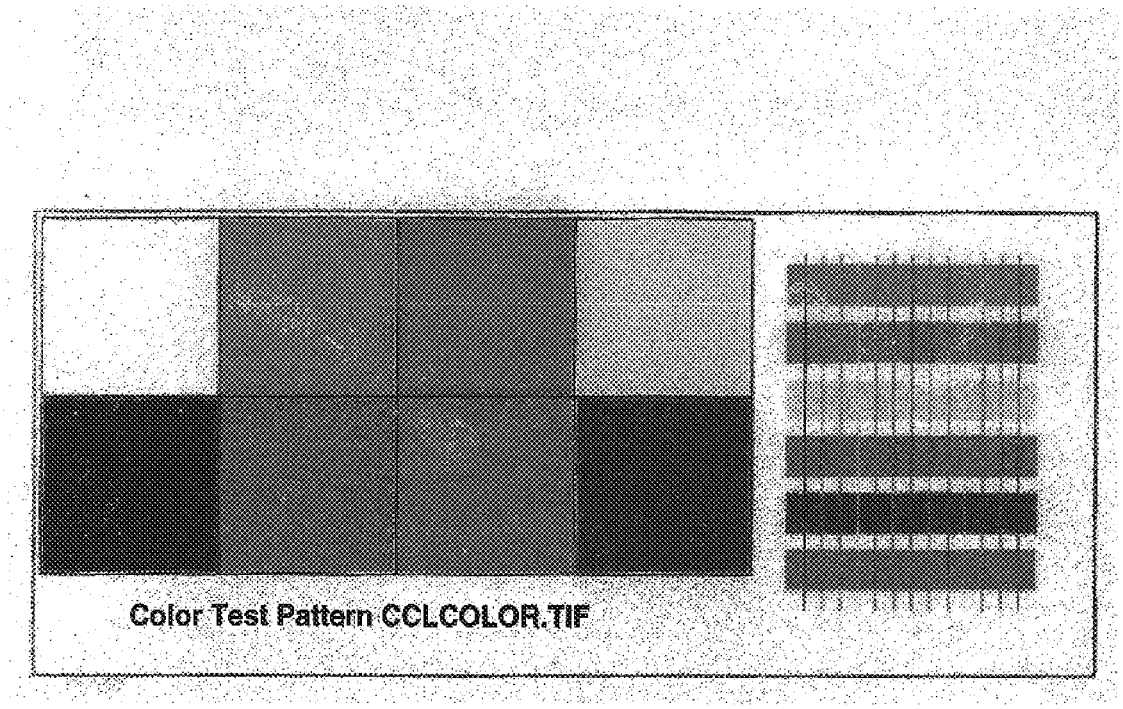
FIG. 21 is a depiction of an imaged macroporous material in accordance with an exemplary embodiment of the present invention after soaking.
Figure 22:
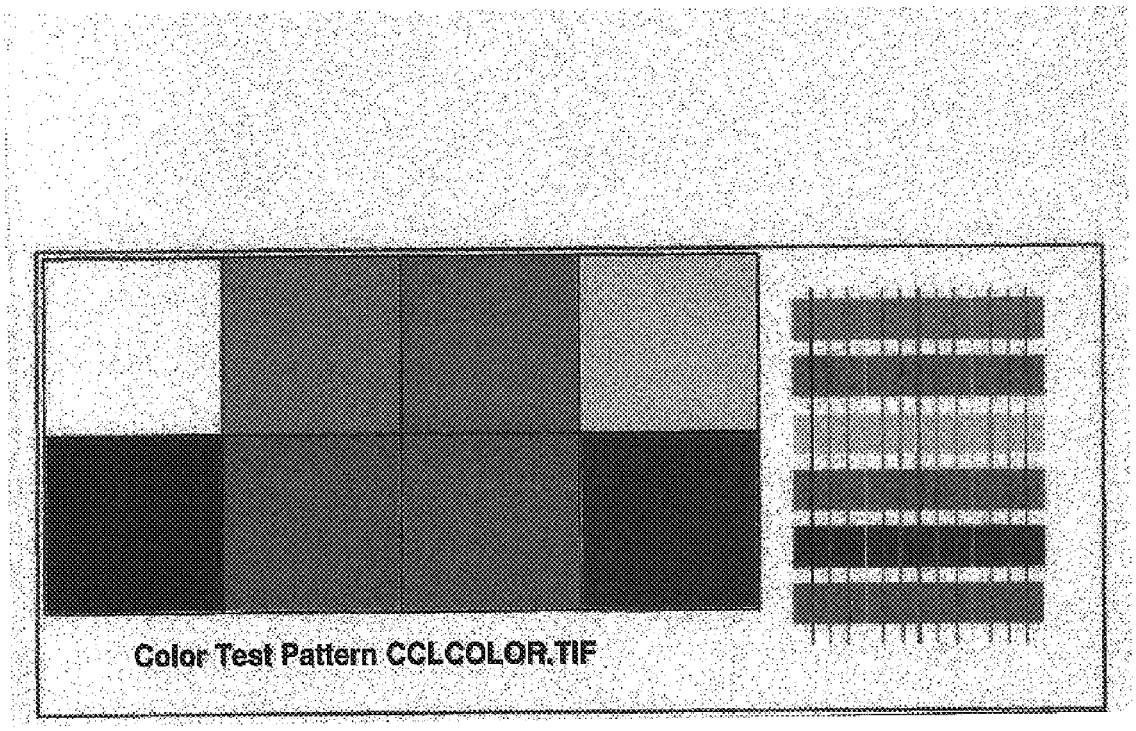
FIG. 22 is a depiction of an imaged macroporous material in accordance with an exemplary embodiment of the present invention.
Figure 23:
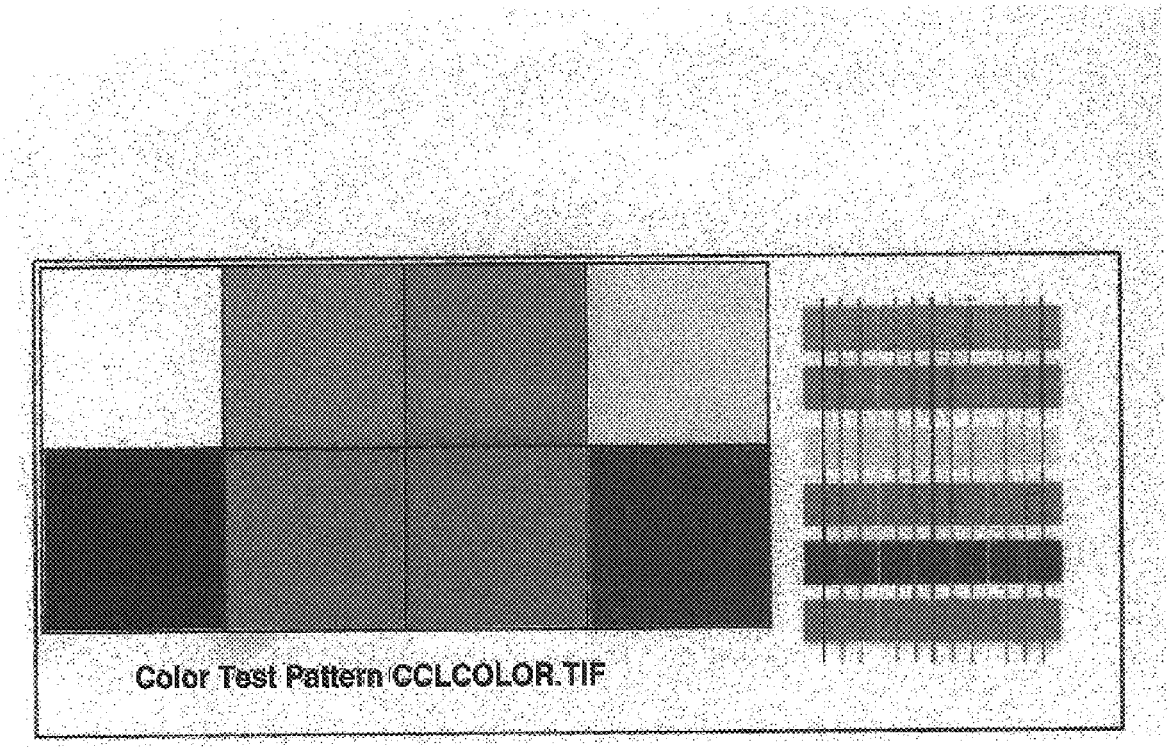
FIG. 23 is a depiction of an imaged macroporous material in accordance with an exemplary embodiment of the present invention after soaking.
Figure 24:
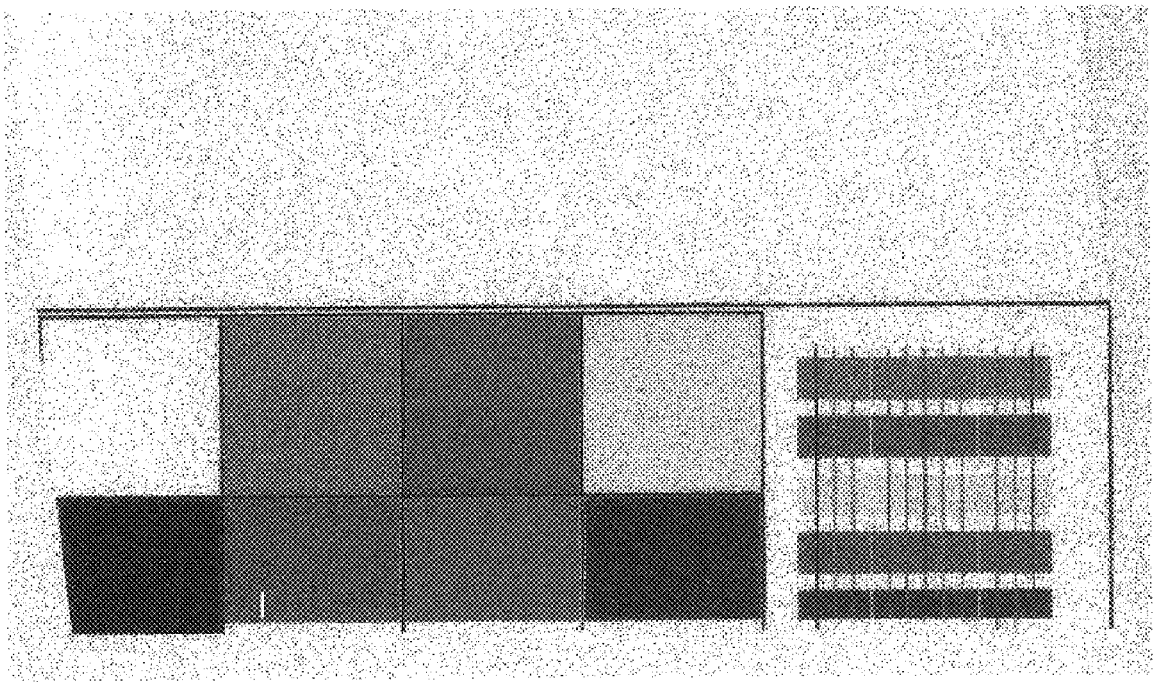
FIG. 24 is a depiction of an imaged macroporous material in accordance with an exemplary embodiment of the present invention.
Figure 25:
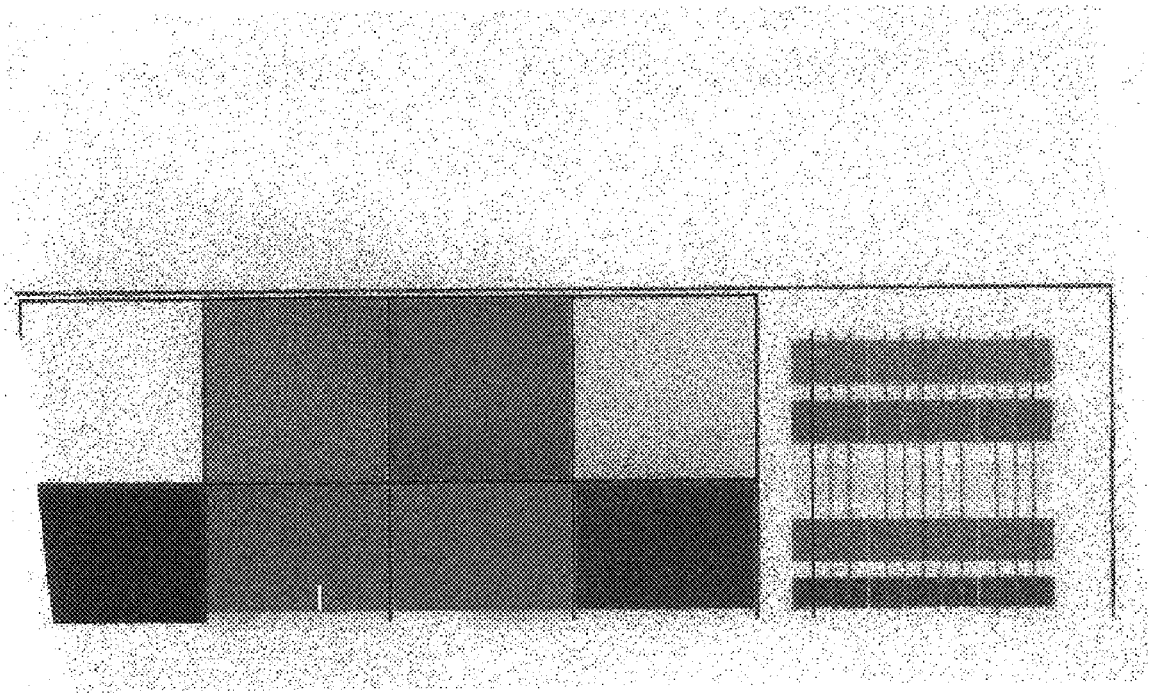
FIG. 25 is a depiction of an imaged macroporous material in accordance with an exemplary embodiment of the present invention after soaking.
Figure 26:
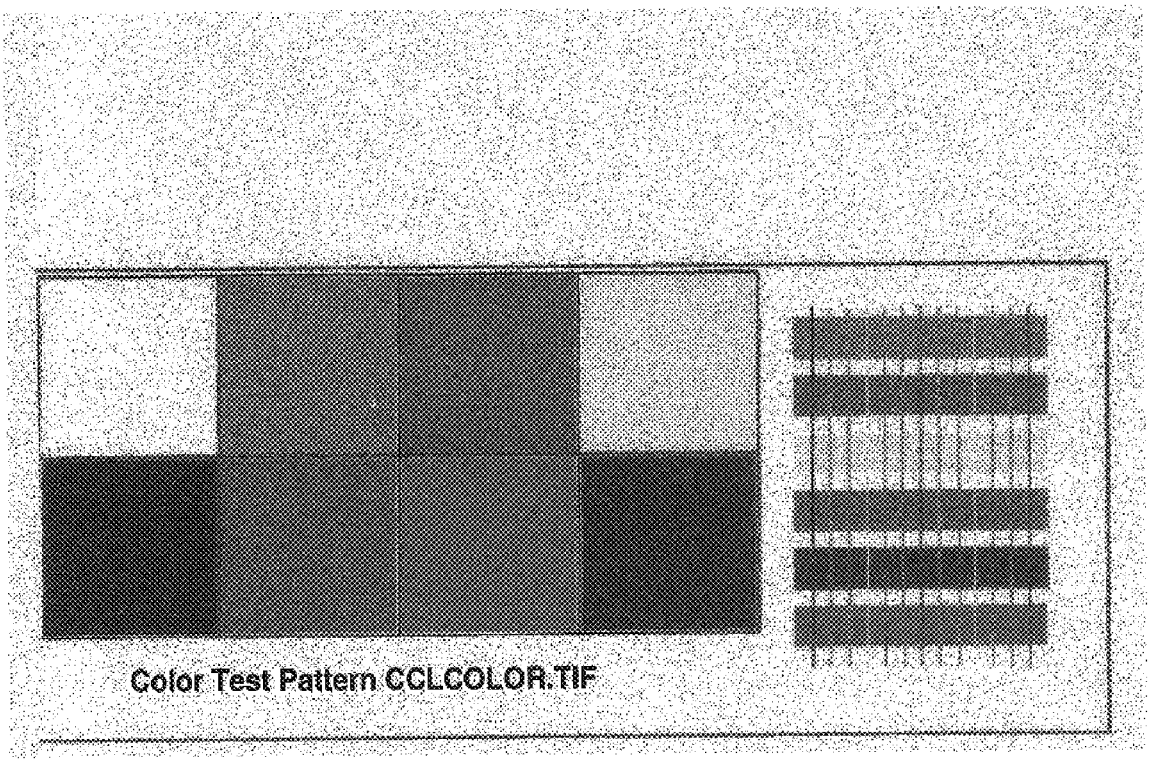
FIG. 26 is a depiction of an imaged macroporous material in accordance with an exemplary embodiment of the present invention.
Figure 27:
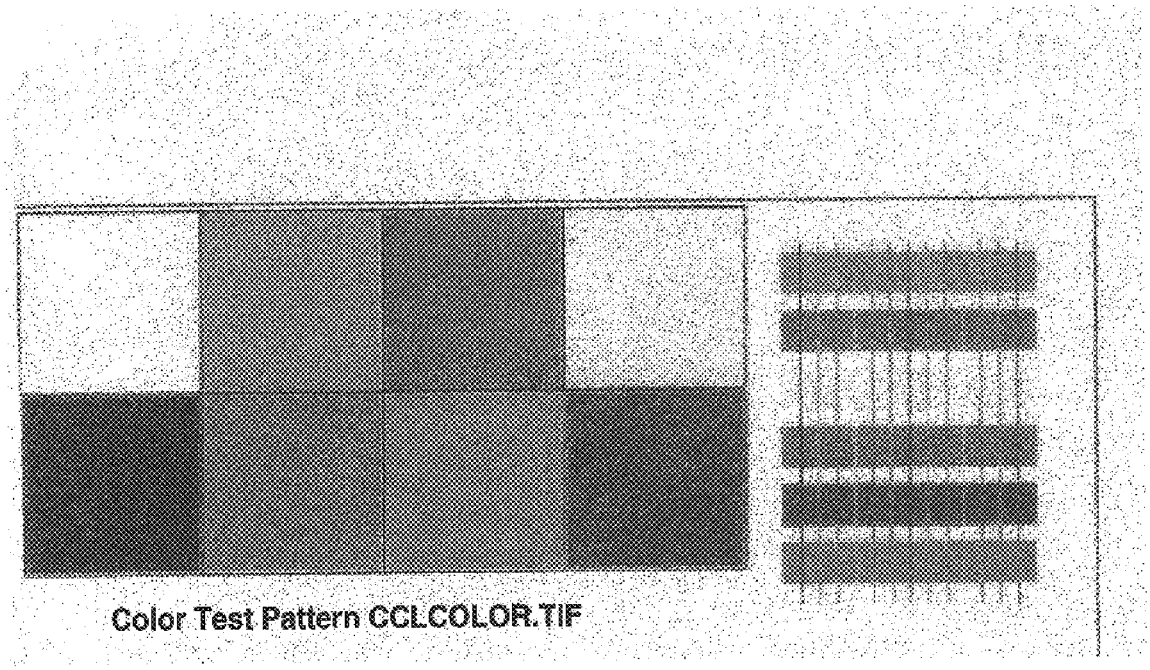
FIG. 27 is a depiction of an imaged macroporous material in accordance with an exemplary embodiment of the present invention after soaking.

FIG. 1 is a cross sectional view of a substrate 100 in accordance with an exemplary embodiment of the present invention. In the embodiment of FIG. 1, substrate 100 comprises a plurality of fibers 102. Fibers 102 define a plurality of pores 104. Pores 104 may comprise micropores, mesopores, and/or macropores. Micropores are pores having a mean diameter less than about 5 nanometers. Mesopores are pores having a mean diameter between about 5 nanometers and about 3 $\mu$m. In a preferred embodiment, substrate 100 comprises a macroporous substrate.

As used herein, a "macroporous substrate" means a substrate having an average pore size of from 3 $\mu$m up to about 5 millimeters, preferably from about 10 $\mu$m up to about 2 millimeters, more preferably from about 100 $\mu$m up to about 0.5 millimeters. In addition, the macroporous substrates of the invention are characterized by having a solidity of from at least about 1 percent up to about 90 percent, preferably from at least about 5 percent up to about 70 percent, and even more preferably from at least about 10 percent up to about 50 percent. It is to be understood, that the pore sizes described above are typical values, and that a macroporous substrate may include pores with sizes lying outside these typical values.

Substrate 100 also includes an ink receptive coating 106 which overlays at least a portion of a plurality of fibers 102. A printed image 108 comprising an ink 110 is disposed on/in substrate 100. Fibers 102 of substrate 100 may be woven or non-woven. In a preferred embodiment, substrate 100 comprises a nonwoven macroporous material. Nonwovens typically comprise a plurality of fibers, which are typically arranged in a substantially randomly intertangled pattern. In some cases the fibers are simply entangled with each other to form a sheet or web. In other cases the fibers are fixed to each other by a binder material which permeates the interstitial spaces between the fibers. The fibers may also be bonded to each other without a binder. It should be noted that other embodiments of substrate 100 are possible without deviating from the spirit and scope of the present invention (e.g., a fabric comprising a plurality of interwoven fibers).

A number of processes may be utilized to manufacture substrate 100 without deviating from the spirit and scope of the present invention. Examples of processes which may be suitable in some applications include melt blowing, air-laying, spin bonding and spinlacing.

Fibers 102 of substrate 100 define a first major surface 112 and a second major surface 114. Substrate 100 may be permeable to gases (e.g., air) and vapors (e.g., water vapor) due to the presence of pores 104. Embodiments of substrate 100 are possible which include a plurality of apertures extending from first major surface 112 to second major surface 114. Apertures may provide, for example, increased permeability. Apertures may be formed in substrate 100 utilizing a needling process.

Substrate

Substrate 100 may comprise a wide variety of materials such as, for example, woven textiles that may comprise natural or synthetic fibers and/or blends thereof; papers, reinforced papers, card stock, synthetic papers; nonwovens such as spunbonded fabrics such as for example "EVOLUTION" brand spun-bonded polypropylene available from Kimberly-Clark Corporation of Neenah, Wis., USA; spun-laced materials such as "SONTARA" brand spun-laced fabric available from E. I. DuPont De Nemours & Co. of Wilmington, Del.; melt blown microfiber (BMF) fabrics, particularly polyolefin BMF fabrics, for example polypropylene BMF materials (including polypropylene blends and also blends of polypropylene and polyethylene); air-laid fiber fabrics, carded fiber fabrics, and stitch-bonded fabrics; wet-laid fabrics; and felts.

Preferred BMF fabrics are formed by collecting the fibers on a smooth surface, typically a smooth-surfaced drum: such materials will be referred to as "smooth BMF materials". BMF fabrics can be formed as described in Wente, Van A. "Superfine Thermoplastic Fibers" in Industrial Engineering Chemistry, vol. 48, pages 1342 et seq. (1956) or in Report No. 4364 of the Naval Research Laboratories, published May 25, 1954, entitled "Manufacture of Superfine Organic Fibers" by Wente, Van A., Boone, C. D., and Fluharty, E. L. The melt-blown microfibers can be formed from thermoplastic fiber-forming materials such as polyolefins, e.g., polyethylene, polypropylene or polybutylene, polyesters such as polyethylene terephthalate or polybutylene terephthalate, polyamides such as NYLON 6 or NYLON 66, polyurethanes, or combinations thereof.

Preferred spunbonded fabrics are formed by extruding a molten thermoplastic material, or coextruding more than one molten thermoplastic material, as filaments from a plurality of fine, usually circular, capillaries in a spinnerette with the diameter of the extruded filaments then being rapidly reduced, for example, by non-eductive or eductive fluid-drawing or other well known spunbonding mechanisms. The production of spunbonded nonwoven fabrics is illustrated in patents such as Appel, et al., U.S. Pat. No. 4,340,563; Dorschner et al., U.S. Pat. No. 3,692,618; Kinney, U.S. Pat. Nos. 3,338,992 and 3,341,394; Levy, U.S. Pat. No. 3,276,944; Peterson, U.S. Pat. No. 3,502,538; Hartman, U.S. Pat. No. 3,502,763; Dobo et al., U.S. Pat. No. 3,542,615; and Harmon, Canadian Patent No. 803,714.

Synthetic organic or inorganic substrates are preferred. Substrates comprising polyplefins, polyesters, and/or polyamides are especially preferred.

An adhesive layer may optionally be present on the major surface of the substrate opposite the ink receptive coating, and is also optionally but preferably protected by a release liner. After imaging, the porous articles of the invention can be adhered to a horizontal or vertical, interior or exterior surface to warn, educate, entertain, etc. The choice of adhesive and release liner depends on usage desired for the image graphic.

Pressure sensitive adhesives can be any conventional pressure sensitive adhesive that adheres to both the substrate and to the surface of the item upon which the inkjet receptor medium is destined to be placed. Pressure sensitive adhesives are generally described in Satas, Ed., Handbook of Pressure Sensitive Adhesives $2^{nd}$ Ed. (Von Nostrand Reinhold 1989). Pressure sensitive adhesives are commercially available from a number of sources. Particularly preferred are acrylate pressure sensitive adhesives commercially available from Minnesota Mining and Manufacturing Company of St. Paul, Minn. and generally described in U.S. Pat. Nos. 5,141,790; 4,605,592; 5,045,386; and 5,229,207 and EPO Patent Publication EP 0 570 515 B1 (Steelman et al.).

Release liners are also well known and commercially available from a number of sources. Nonlimiting examples of release liners include silicone coated kraft paper, silicone coated polyethylene coated paper, silicone coated and non-coated polymeric materials such as polyethylene or polypropylene, as well as the aforementioned base materials coated with polymeric release agents such as silicone urea, urethanes, and long chain alkyl acrylates, such as defined in U.S. Pat. Nos. 3,957,724; 4,567,073; 4,313,988; 3,997,702; 4,614,667; 5,202,190; and 5,290,615 and those liners commercially available as POLYSLIK brand liners from Rexam Release of Oakbrook, Ill., and EXHERE brand liners from P.H. Glatfelter Company of Spring Grove, Pa.

After the porous medium of the invention has been printed with an image, an optional protective laminate layer (not shown) may be adhered to the printed surface. The overlaminate layer improves the weather resistance of the film by helping to protect the film from ambient humidity, direct sunlight and other weathering effects, as well as protecting the image from nicks, scratches, and splashes. In addition, the overlaminate layer can impart a desired finish to the image, such as high gloss or matte. Suitable overlaminate layers include any suitable transparent plastic sheet material bearing an adhesive on one surface. Use of such overlaminates is, for example, described in U.S. Pat. No. 4,966,804.

Fibers

Fibers 102 of substrate 100 may comprise thermoplastic and/or non-thermoplastic materials without deviating from the spirit and scope of the present invention. Suitable fibers include synthetic organic or inorganic fibers, natural fibers, and combinations thereof. The choice of fibers depends upon, for example, fiber cost and the desired properties, e.g., liquid resistance, vapor permeability or liquid wicking, or the finished drape.

Useful natural fibers include cellulosic fibers (such as bleached or unbleached hardwood or softwood pulps), cotton, viscose rayon, cuprammonium rayon, ramie, hemp, sisal, linen, jute, straw, and the like as well as proteinaceous fibers such as wool, mohair, silk, etc.

Useful synthetic fibers include poly(caproamide) (NYLON 6), poly(hexamethylene diamine adipate) (NYLON 66) and other polyamides of both the poly(amino acid) type and poly(diamine dicarboxylate) types such as poly(hexamethylene diamine sebacate) known as NYLON 6-12. Also suitable are polyesters such as poly(ethylene terephthalate) (PET), poly(butylene terephthalate) and the like, polyimide fibers, polyamide fibers, polyethylene fibers, and the like, and combinations thereof; polyolefins, e.g., polyethylene, polypropylene, polybutylene, and the like; polyacrylonitriles; polycarbonates; polystyrenes; thermoplastic elastomers, e.g., ethylenepropylene rubbers, styrenic block copolymers, copolyester elastomers and polyamide elastomers and the like; fluoropolymers, e.g., polytetrafluoroethylene and polytrifluorochloroethylene; vinyl polymers, e.g., polyvinyl chloride; polyurethanes; polyvinyl alcohol homopolymers and copolymers (including hydrolyzed copolymers of vinyl esters, particularly hydrolyzed copolymers of vinyl acetate); and blends and copolymers thereof. Preferred fibers are cellulosic fibers, NYLONs, polyesters and polyolefins. Most preferred are polyesters, especially polyethylene terephthalate, and polyolefins, particularly polyethylene and polypropylene.

Useful inorganic fibers include carbon or graphite fibers, glass fibers, ceramic fibers, boron fibers, silicon carbide fibers, and combinations thereof. Such fibers may be present as a woven, nonwoven, or knitted fabric.

Fibers comprising polyethylene terephthalate (PET) are commercially available from E. I. Du Pont de Nemours Corporation of Wilmington, Del. which identifies this material with the trade designation DACRON. Fibers comprising polyparaphenylene terephthalamide are commercially available from E. I. Du Pont de Nemours Corporation of Wilmington, Del. which identifies this material with the trade designation KEVLAR. Fibers comprising polymetaphenylene diamine are commercially available from E. I. Du Pont de Nemours Corporation of Wilmington, Del. which identifies this material with the trade designation NOMAX. Fibers comprising glass are commercially available from Owens-Corning Fiberglas Corporation of Toledo, Ohio.

Ink Receptive Coating

In a preferred embodiment, a plurality of fibers 102 of substrate 100 are coated with ink receptive coating 106. In a useful embodiment, ink receptive coating 106 comprises a plurality of particles which may be organic or inorganic particles. In a preferred embodiment, ink receptive coating 106 comprises a plurality of organic particles and a plurality of inorganic particles.

Suitable hydrophilic organic particles comprise crosslinked homopolymers and copolymers of N-vinyllactams such as homopolymers and copolymers of N-vinylpyrrolidone and homopolymers and copolymers of N-vinylcaprolactam, homopolymers and copolymers of N-vinylimidazoles, homopolymers and copolymers of vinylpyridine, and substituted derivatives thereof. Homopolymers and copolymers of N-vinyllactams and N-vinylimidazoles are preferred. Crosslinked particles of poly(N-vinylpyrrolidone) and poly(N-vinylimidazole) are most preferred.

Crosslinked particles of poly(N-vinylpyrrolidone) are commercially available from International Specialty Products of Wayne, N.J. which identifies them by the trade designation POLYPLASDONE and POLYCLAR. Crosslinked vinylpyrrolidone-vinylimidazole copolymer particles, available from BASF Corporation of Ludwigshafen, Germany which identifies them by the trade designation LUVICROSS VI and LUVICROSS VI-M.

A useful mean particle diameter for organic particles is between about 0.10 micrometer and about 500 micrometers. A preferred mean particle diameter for organic particles is between about 0.5 micrometers and about 200 micrometers. A more preferred mean particle diameter for organic particles is between about 1 micrometers and about 100 micrometers. It is to be understood, that the particle sizes described above are typical values, and that a coating in accordance with the present invention may include particles with sizes lying outside these typical values.

In a useful embodiment, the organic particles have the capacity to absorb ink. Because ink absorbing capacity may vary with the composition of the ink being absorbed, preferred absorbing capacities will be described in terms of water absorbing capacity. In a preferred embodiment, the organic particles have a water absorbing capacity of between 40 ml/g and 0.1 ml/g. In a more preferred embodiment, the organic particles have a water absorbing capacity of between 20 ml/g and 0.2 ml/g. In a most preferred embodiment, the organic particles have a water absorbing capacity of between 10 ml/g and 0.5 ml/g.

Suitable inorganic particles comprise metal oxides. Preferred metal oxides include titanium oxides such as rutile, titanium monoxide, titanium sesquioxide; silicon oxides, such as silica, surfactant templated silica particles, zeolites, and surface treated derivative thereof such as for example fluorinated silicas as described in PCT published Patent Appl. No. WO 99/03929 A1; aluminum oxides such as aluminas, for example boehmite, pseudo-boehmite, bayerite, mixed oxides such as aluminum oxyhydroxide, alumina particles having a silica core; zirconium oxides such as zirconia and zirconium hydroxide; and mixtures thereof. Silicon oxides and aluminum oxides are especially preferred.

Silica particles are commercially available from, for example, E. I. Du Pont de Nemours Corporation of Wilmington, Del. which identifies them with the trade designation LUDOX. Alumina particles are commercially available from, for example, Vista Chemical Company of Houston, Tex. which identifies them with the trade designation DISPAL. A preferred mean particle diameter for inorganic particles is between about 0.002 micrometer and about 100 micrometers. A more preferred mean particle diameter for inorganic particles is between about 0.02 micrometer and about 30 micrometers. It is to be understood, that the particle sizes described above are typical values, and that a coating in accordance with the present invention may include particles with sizes lying outside these typical values.

In a preferred embodiment, ink receptive coating 106 comprises inorganic particles and organic particles and the ratio of organic particles to inorganic particles is between about 5:95 and about 90:10 by weight. In a more preferred embodiment, ink receptive coating 106 comprises inorganic particles and organic particles and the ratio of organic particles to inorganic particles is between about 50:50 and about 20:80 by weight. In a most preferred embodiment, ink receptive coating 106 comprises inorganic particles and organic particles and the ratio of organic particles to inorganic particles is between about 40:60 and about 25:75 by weight.

Ink receptive coating 106 may include one or more binders to help in holding the particles to the substrate and to each other. The binder may be water soluble or water insoluble. Preferably, the binder is dispersed or dissolved in water, but becomes substantially water insoluble upon drying. A useful embodiment of ink receptive coating 106 generally comprises less than 80% binder by weight. Preferably, ink receptive coating 106 comprises less than 60% binder by weight. More preferably, ink receptive coating 106 comprises less than 40% binder by weight.

Suitable binders may be hydrophilic or hydrophobic and include natural polymers, synthetic resins, polymers and copolymers and other film forming media such as: gelatin; gum arabic; poly(vinyl alcohol); cellulose esters, such as hydroxyethyl cellulose, cellulose acetate, cellulose acetate butyrate; poly(vinyl pyrrolidone); casein; starch; poly (acrylic acid); poly(methacrylic acid); poly(vinyl chloride); polystyrenes, such as, poly(styrene-co-maleic anhydride), poly(styrene-co-acrylonitrile), and poly(styrene-co-butadiene); acrylics; polyacrylonitrile; polyvinyl acetals, such as poly(vinyl formal) and poly(vinyl butyral); polyesters; polyurethanes; phenoxy resins; poly(vinylidene chloride); polyepoxides; polycarbonates; poly(vinyl acetate); polyolefins, such as, poly(ethylene) and poly (propylene); polyamides, etc. Polyvinyl alcohols, acrylic polymers, and ethylene/vinyl acetate copolymers are preferred binders. Polyvinyl alcohols are especially preferred binders. The binders may be applied as solutions or emulsions from either aqueous or organic solvent. For aesthetic reasons, preferred binders have a glass transition temperature of from about −40° C. up to about 50° C.

It is to be appreciated that image receptive coating 106 may include various additives without deviating from the spirit and scope of the present invention. Examples of additives which may be suitable in some applications include dyes, colorants, pigments, fillers, lubricants, antioxidants, ultraviolet light stabilizers, heat stabilizers, surfactants, viscosity modifiers, fragrances, and the like.

In a useful embodiment, the image receptive coating has a weight of between about 1 $g/m^2$ and about 300 $g/m^2$. In a preferred embodiment, the image receptive coating has a weight of between about 3 $g/m^2$ and about 200 $g/m^2$. In a particularly preferred embodiment, the image receptive coating has a weight of between about 5 $g/m^2$ and about 100 $g/m^2$.

Coating Solution and Methods

In a preferred method in accordance with the present invention, ink receptive coating 106 is formed by applying a coating solution to fibers 102 of substrate 100. Various methods may be utilized to apply the coating solution onto substrate 100 without deviating from the spirit and scope of the present invention. Examples of coating processes which may be suitable in some applications include spraying, dipping, slot fed knife coating, and roll coating, and rotogravure coating.

In some applications it may be advantageous to include a surfactant in the coating solution to aid in wetting the substrate. Examples of surfactants which may be suitable in some applications include anionic surfactants, cationic surfactants, nonionic surfactants, and zwitterionic surfactants. Examples of trade designations for surfactants include ZONYL and FLUORAD. ZONYL FSN is a trade designation for a fluorinated surfactant available from E. I. Du Pont de Nemours Corporation of Wilmington, Del. FLUORAD FC-754 well stimulation additive is a trade designation for a well stimulation additive available from Minnesota Mining and Manufacturing Company (3M Company) of St. Paul, Minn. In a preferred embodiment, the coating solution includes a cationic surfactant. Compositions including cationic surfactants have resulted in images exhibiting slightly less bleed than those containing anionic or nonionic surfactants.

The quantity of the surfactant may be selected to obtain the desired wetting characteristics. Useful wetting may be obtained when the surface tension of the coating solution is generally less than the wetting tension of the substrate material of fibers 102. Advantageous wetting may be obtained when the surface tension of the coating solution is less than the wetting tension of the substrate material by a difference of about 5 $mJ/m^2$ or more. Particularly advantageous wetting may be obtained when the surface tension of the coating solution is less than the wetting tension of the substrate material by a difference of about 10 $mJ/m^2$ or more. By way of example, untreated polypropylene typically has a surface tension of about 29 $mJ/m^2$. A corresponding useful coating solution in accordance with the present invention has a surface tension of less than about 29 $mJ/m^2$. A preferred coating solution in accordance with the present invention has a surface tension of less than about 24 $mJ/m^2$. A particularly preferred coating solution in accordance with the present invention has a surface tension of less than about 19 $mJ/m^2$.

A method in accordance with the present invention may include a fiber surface treatment step. Examples of surface treatment processes which may be suitable in some applications include plasma treating, corona treating, chemical treating, and flame treating. Flame treating equipment which may be suitable in some applications is commercially available from Flynn Burner Corporation of New Rochelle N.Y., The Aerogon Company Ltd. of Alton United Kingdom, and Sherman Treaters Ltd. of Thame, United Kingdom. Corona treating equipment which may be suitable in some applications is commercially available from Enercon Industries Corporation of Menomonee Falls, Wis., Pillar Technologies of Hartland, Wis., and Corotec Corporation of Farmington, Conn.

Printed Image

In a preferred embodiment, ink receptive coating 106 is capable of receiving a printed image comprising aqueous ink. In a preferred method, the image is printed onto image receptive coating 106 utilizing an inkjet printing process. Other printing methods may be utilized without deviating from the spirit and scope of the present invention. Examples of printing methods which may be suitable in some applications include laser printing , gravure printing, offset printing, silk screen printing, electrostatic printing, and flexographic printing.

In a preferred method in accordance with the present invention, printed image 108 is applied to ink receptive coating 106 utilizing an inkjet printing process. One advantage of the inkjet printing process is that inkjet printing equipment is readily available at low cost. A second advantage of the inkjet printing process is that inkjet printers can create photographic quality color images with no set up costs (e.g., printing plates and the like).

Many inks may be utilized in conjunction with the present invention. Examples of inks which may be suitable in some applications include organic solvent based inks, water-based inks, phase change inks, and radiation polymerizable inks. Inks utilizing various colorants may be utilized in conjunction with the present invention. Examples of colorants which may be suitable in some applications include dye based colorants, and pigment based colorants.

Utility of the Invention

When a web comprising uncoated polypropylene fibers was imaged utilizing an inkjet printer, a portion of the inkjet ink wicks along the fibers of the web. When a coating in accordance with the present invention is applied to a web, it is less likely that ink will wick along the fibers of the web. This is because the coating quickly absorbs the ink; not allowing it to pool in the pores or/and or wick along the fibers of the web.

An inkjet receptive web in accordance with the present invention becomes dry to the touch rapidly when it is imaged with aqueous ink from an inkjet printer. When an inkjet receptive web in accordance with the present invention is imaged with aqueous ink from an inkjet printer the resulting image is substantially free of printing defects. Examples of printing defects include feathering, bleeding, blurring, splattering, banding, and mudcracking.

EXAMPLES

Materials

The materials utilized in the examples which follow are described below:

"REEMAY" is a trade designation for a non-woven material comprising spunbonded polyester fibers available from Reemay Incorporated of Old Hickory, Tenn.

"POLYPLASDONE INF-10" is a trade designation for crosslinked poly(vinylpyrrolidone) particles available from International Specialty Products of Wayne, N.J.

"DISPAL 23N4-20" is a trade designation for alumina sol available from Vista Chemical Company of Houston, Tex.

"METHOCEL F-50" is a trade designation for a Hydroxypropylmethylcelluose (HPMC) polymer available from Dow Chemical of Midland, Mich.

"FLUORAD FC-754 WELL STIMULATION ADDITIVE" is a trade designation for a mixture of fluoroalkyl quaternary ammonium chlorides, 50 weight percent in isopropanol/water available from 3M Company of St. Paul, Minn.

"ZONYL FSN" is a trade designation for a fluorinated surfactant available from E. I. Du Pont de Nemours Corporation of Wilmington, Del.

"VINOL 540" is a trade designation for a Polyvinyl alcohol (PVA) available from Air Products Polymers LP of Allentown, Pa.

General Procedures

In the examples which follow, the term "parts" refers to parts by weight unless otherwise specified and the term "dpi" refers to dots per inch.

Test Procedures

In the examples below, qualitative ratings were made of image drying time, resolution, image density, and resistance to water. The qualitative ratings were done on a 1 to 4 scale with 1 denoting the most desirable performance.

A drying time rating of 1 indicates that the image felt dry to the touch immediately out of the printer. A drying time rating of 4 indicates that the image could be smeared easily with moderate finger pressure for more than 1 minute after the sheet was in the paper tray.

The reflective optical density of imaged samples was measured utilizing a Gretag Model SPM55 Reflection Spectrophotometer.

The moisture/water resistance of the samples was tested in two ways. In some cases the imaged samples were placed in a 48° C., 65% relative humidity environmental chamber for at least 3 days. In some cases the imaged samples were sprayed with a stream of de-ionized water for up to 5 minutes.

Comparative Example 1

A sample of BMF (100 g/m $^2$) polypropylene nonwoven web material was digitally imaged utilizing a Hewlett Packard HP-855c inkjet printer operating at 360 dpi. The resulting image showed a reduced brightness (reflective optical density) due to colorants in the ink partially penetrating though the web. The ink could be wiped off with moderate finger pressure, and showed significant feathering along the nonwoven fibers.

The printed image was evaluated and qualitative ratings were made of image drying time, resolution, image density, and resistance to water. The qualitative ratings were done on a 1 to 4 scale with 1 denoting the most desirable performance. The qualitative results are displayed in Table 1 below.

Comparative Example 2

A 2% solids solution of METHOCEL F-50 in water was prepared. The solution was coated onto a sample of BMF (100 g/m$^2$) nonwoven web material utilizing a #16 Mayer rod. The coating solution was dried in a laboratory oven at 100° C. for 3 minutes.

It was noted that the coating was partially dewetting from the web, due to the solution's much higher surface tension than the backing's surface energy.

After coating, the sample was digitally imaged utilizing a Hewlett Packard HP-855c inkjet printer operating at 360 dpi.

The resulting image was of better quality than that of Comparative Example 1 (i.e. better line edge definition, no significant feathering, but some nonuniformity due to the dewetting of the original coating solution).

The printed image was almost dry to the touch immediately after printing.

This solution was remade with a 10% of the coating solution (by weight) consisting of isopropanol (IPA). This solution coated well onto the BMF, and when imaged, gave a more uniform image.

Comparative Example 3

A coating solution in accordance with the formula described in the table below was prepared.

| | |
|---|---|
| 2 parts | DISPAL 23N4-20 (Alumina Sol) |
| 10 parts | Isopropanol |
| 88 parts | Water |

The solution was coated onto a sample of BMF (100 g/m$^2$) nonwoven web material utilizing a #16 Mayer rod. The coating solution was dried in a laboratory oven at 100° C. for 3 minutes.

After coating, the sample was digitally imaged utilizing a Hewlett Packard HP-855c inkjet printer operating at 360 dpi.

The printed image was evaluated as in the above examples. The qualitative results are displayed in Table 1.

Comparative Example 4

A coating solution in accordance with the formula described in the table below was prepared.

| | |
|---|---|
| 1.3 parts | METHOCEL F50 (HPMC polymer) |
| 0.7 parts | DISPAL 23N4-20 (Alumina Sol) |
| 10.0 parts | Isopropanol |
| 88.0 parts | Water |

The solution was coated onto a sample of BMF (100 g/m$^2$) nonwoven web material utilizing a #16 Mayer rod. The coating solution was dried in a laboratory oven at 100° C. for 3 minutes.

After coating, the sample was digitally imaged utilizing a Hewlett Packard HP-855c inkjet printer operating at 360 dpi. Quite good image quality was displayed.

The printed image was evaluated as in the above examples. The qualitative results are displayed in Table 1.

Comparative Example 5

A coating solution in accordance with the formula described in the table below was prepared.

| | |
|---|---|
| 1.5 parts | METHOCEL F50 (HPMC polymer) |
| 0.7 parts | DISPAL 23N4-20 (Alumina Sol) |

-continued

| | |
|---|---|
| 0.1 parts | FLUORAD FC-754 (surfactant) |
| 13.0 parts | Isopropanol |
| 84.7 parts | Water |

The solution was coated onto a sample of BMF (100 g/m$^2$) nonwoven web material utilizing a #16 Mayer rod. The coating solution was dried in a laboratory oven at 100° C. for 3 minutes.

After coating, the sample was digitally imaged utilizing a Hewlett Packard HP-855c inkjet printer operating at 360 dpi. Quite good image quality was displayed.

The printed image was evaluated as in the above examples. The qualitative results are displayed in Table 1.

Example 1

A coating solution in accordance with the formula described in the table below was prepared.

| | |
|---|---|
| 3.0 parts | INF-10 (x-PVP particles) |
| 7.0 parts | DISPAL 23N4-20 (Alumina Sol) |
| 10.0 parts | Isopropanol |
| 80.0 parts | Water |

The solution was coated onto a sample of BMF (100 g/m$^2$) nonwoven web material utilizing a #16 Mayer rod. The coating solution was dried in a laboratory oven at 100° C. for 3 minutes.

After coating, the sample was digitally imaged utilizing a Hewlett Packard HP-855c inkjet printer operating at 360 dpi. Good image quality was observed.

The printed image was evaluated as in the above examples. The qualitative results are displayed in Table 1.

When this sample was evaluated for waterfastness, very good results were obtained. The imaged sample produced and left to stand for about 1 hour was washed under a stream of deionized water for about 5 minutes. Essentially no colorant (dye) moved from the initial image, as determined from inspection of the target resolution lines.

Example 2

A coating solution in accordance with the formula described in the table below was prepared.

| | |
|---|---|
| 3.0 parts | INF-10 (x-PVP particles) |
| 6.5 parts | DISPAL 23N4-20 (Alumina Sol) |
| 0.5 parts | FLUORAD FC-754 (surfactant) |
| 10.0 parts | Isopropanol |
| 80.0 parts | Water |

The solution was coated onto a sample of BMF (100 g/m$^2$) nonwoven web material utilizing a #16 Mayer rod. The coating solution was dried in a laboratory oven at 100° C. for 3 minutes.

After coating, the sample was digitally imaged utilizing a Hewlett Packard HP-855c inkjet printer operating at 360 dpi. Good image quality was observed.

The printed image was evaluated as in the above examples. The qualitative results are displayed in Table 1.

When this sample was evaluated for waterfastness, very good results were obtained. The imaged sample produced and left to stand for about 1 hour was washed under a stream of deionized water for about 5 minutes. Essentially no colorant (dye) moved from the initial image, as determined from inspection of the target resolution lines.

Example 3

A coating solution in accordance with the formula described in the table below was prepared.

| | |
|---|---|
| 3.0 parts | INF-10 (x-PVP particles) |
| 6.5 parts | DISPAL 23N4-20 (Alumina Sol) |
| 0.5 parts | FLUORAD FC-754 (surfactant) |
| 10.0 parts | Isopropanol |
| 80.0 parts | Water |

The solution was coated onto a sample of REEMAY type 6120 polyester nonwoven web material utilizing a #16 Mayer rod. The coating solution was dried in a laboratory oven at 100° C. for 3 minutes.

After coating, the sample was digitally imaged utilizing a Hewlett Packard HP-855c inkjet printer operating at 360 dpi. Excellent image quality was obtained, whereas this uncoated nonwoven gave results similar to the BMF web of Comparative Example 1.

The printed image was evaluated as in the above examples. The qualitative results are displayed in Table 1.

Example 4

A coating solution in accordance with the formula described in the table below was prepared.

| | |
|---|---|
| 3.5 parts | INF-10 (x-PVP particles) |
| 7.0 parts | DISPAL 23N4-20 (Alumina Sol) |
| 1.0 parts | VINOL 540 (polyvinyl alcohol) |
| 0.5 parts | FLUORAD FC-754 (surfactant) |
| 5.0 parts | Isopropanol |
| 83.0 parts | Water |

The solution was coated onto both a BMF (100 g/m$^2$) nonwoven web and a REEMAY type 6120 polyester nonwoven web.

The coating was applied at a nominal thickness of 2 mils (0.051 mm) wet using a pilot scale coater (Talboys Engineering). The coater was operated at a linear speed of 5 feet/minute. The web passed through an 8 foot heating zone using forced air drying at 220° F.

After coating, both samples were digitally imaged utilizing a Hewlett Packard HP-855c inkjet printer operating at 360 dpi.

Excellent image quality and waterfastness were observed for both nonwoven web types.

The printed image was evaluated as in the above examples for both nonwoven web types. The qualitative scores for both nonwoven web types were identical, these results are displayed in Table 1 below.

TABLE 1

Qualitative Results from Examples 1–4 and Comparative Examples 1–5

| Example # | Image Dry Time | Resolution Feathering | Reflective Optical Density | Moisture Resistance |
|---|---|---|---|---|
| Comparative Example 1 | 4 | 4 | 3 | 4 |
| Comparative Example 2 | 2 | 2 | 2 | 3 |
| Comparative Example 3 | 2 | 3 | 2 | 3 |
| Comparative Example 4 | 1 | 1.5 | 1.5 | 3 |
| Comparative Example 5 | 1 | 1 | 1 | 3 |
| Example 1 | 1.5 | 1 | 1.5 | 1 |
| Example 2 | 1 | 1 | 1 | 1 |
| Example 3 | 1 | 1 | 1 | 1 |
| Example 4 | 1 | 1 | 1 | 1 |

Comparative Examples 6 and 7 and Examples 5–15 shown in Table 2 demonstrate the effect of varying the ratio of crosslinked polyvinyl pyrrolidone particles(i.e., denoted x-PVP, INF-10 grade) to alumina (i.e., DISPAL 23N4-20) at a constant binder (i.e., AIRVOL 540) content. Example 13–15 show the effect of varying the total combined amount of alumina and x-PVP particles in the ink receiving layer relative to the binder while maintaining a constant ratio of the two ingredients. Additional materials used in Table 2 were FLUORAD FC-754 well stimulation additive (i.e., denoted FC-754), deionized water and isopropanol. The nonwoven substrate was the same as in Comparative Example 1. The mixtures were coated with a #16 Mayer rod and dried for 3 minutes at 100° C. (dry coating weight was 10 g/m2). Amounts shown in Table 2 are in parts by weight.

The coated substrate was imaged using an Hewlett-Packard HP 855c inkjet printer as described in Comparative Example 1 and allowed to dry for 1 day under ambient conditions. Reflective optical densities were measured (as in Comparative Example 1) and the image was captured by scanning it with an Hewlett-Packard HP 4c SCANJET (Millions of Colors setting using Hewlett-Packard HP Desk Scan II software).

Each sample was individually immersed in a pan containing deionized water for 15 hours. The water depth was at least 1 cm over the imaged nonwoven. Afterward, the respective samples were removed from the water, allowed to drip until no more water would drip off, then allowed to dry at ambient room temperature for 1 hour. The samples were then placed in a 60° C. convection oven for 10 minutes to finish drying them. Reflective color densities were measured again as shown in Table 3, and the images were recorded again by scanning as before with the HP 4c SCANJET. Table 4 is a list of figures including a description of the correlation between the figures, Examples 5–15 and Comparative Examples 6 and 7.

TABLE 2

| Example | alumina | x-PVP | Binder | FC-754 | water | IPA |
|---|---|---|---|---|---|---|
| Comparative Example 6 | 0 | 0 | 1 | 0.5 | 88.5 | 10 |

TABLE 2-continued

| Example | alumina | x-PVP | Binder | FC-754 | water | IPA |
|---|---|---|---|---|---|---|
| Comparative Example 7 | 9 | 0 | 1 | 0.5 | 79.5 | 10 |
| Example 5 | 0 | 9 | 1 | 0.5 | 79.5 | 10 |
| Example 6 | 8.1 | 0.9 | 1 | 0.5 | 79.5 | 10 |
| Example 7 | 6.75 | 2.25 | 1 | 0.5 | 79.5 | 10 |
| Example 8 | 6 | 3 | 1 | 0.5 | 79.5 | 10 |
| Example 9 | 4.5 | 4.5 | 1 | 0.5 | 79.5 | 10 |
| Example 10 | 3.5 | 5.5 | 1 | 0.5 | 79.5 | 10 |
| Example 11 | 2.25 | 6.75 | 1 | 0.5 | 79.5 | 10 |
| Example 12 | 1 | 8 | 1 | 0.5 | 79.5 | 10 |
| Example 13 | 5 | 2.5 | 2.5 | 0.5 | 79.5 | 10 |
| Example 14 | 3.33 | 1.67 | 5 | 0.5 | 79.5 | 10 |
| Example 15 | 2.33 | 1.17 | 6.5 | 0.5 | 79.5 | 10 |

TABLE 3

| | | Reflective Color Dens. | | | |
|---|---|---|---|---|---|
| Example | | black | cyan | magenta | yellow |
| Comparative Example 6 | before soaking | 1.16 | 0.86 | 0.77 | 0.66 |
| | after soaking | 1.11 | 0.53 | 0.29 | 0.02 |
| Comparative Example 7 | before soaking | 1.26 | 1.01 | 0.93 | 0.76 |
| | after soaking | 1.21 | 1.00 | 0.88 | 0.72 |
| Example 5 | before soaking | 1.16 | 0.71 | 0.65 | 0.59 |
| | after soaking | 1.1 | 0.78 | 0.65 | 0.25 |
| Example 6 | before soaking | 1.27 | 0.99 | 0.93 | 0.71 |
| | after soaking | 1.26 | 1.02 | 0.89 | 0.67 |
| Example 7 | before soaking | 1.26 | 1.01 | 0.95 | 0.75 |
| | after soaking | 1.25 | 1.04 | 0.91 | 0.73 |
| Example 8 | before soaking | 1.22 | 0.94 | 0.89 | 0.74 |
| | after soaking | 1.2 | 1.06 | 0.9 | 0.74 |
| Example 9 | before soaking | 1.25 | 0.96 | 0.9 | 0.74 |
| | after soaking | 1.19 | 1.01 | 0.92 | 0.72 |
| Example 10 | before soaking | 1.17 | 0.88 | 0.8 | 0.67 |
| | after soaking | 1.13 | 0.85 | 0.72 | 0.55 |
| Example 11 | before soaking | 1.28 | 0.92 | 0.84 | 0.74 |
| | after soaking | 1.16 | 0.8 | 0.84 | 0.81 |
| Example 12 | before soaking | 1.23 | 0.8 | 0.74 | 0.69 |
| | after soaking | 1.14 | 0.73 | 0.81 | 0.69 |
| Example 13 | before soaking | 1.23 | 0.95 | 0.87 | 0.72 |
| | after soaking | 1.18 | 1.01 | 0.82 | 0.69 |
| Example 14 | before soaking | 1.16 | 0.91 | 0.85 | 0.74 |
| | after soaking | 1.18 | 1.03 | 0.92 | 0.72 |
| Example 15 | before soaking | 1.05 | 0.9 | 0.84 | 0.72 |
| | after soaking | 0.91 | 0.84 | 0.77 | 0.51 |

TABLE 4

| FIGURE | DESCRIPTION |
|---|---|
| 1 | cross sectional view |
| 2 | comparative example 6 before soaking |
| 3 | comparative example 6 after soaking |
| 4 | comparative example 7 before soaking |
| 5 | comparative example 7 after soaking |
| 6 | example 5 before soaking |
| 7 | example 5 after soaking |
| 8 | example 6 before soaking |
| 9 | example 6 after soaking |
| 10 | example 7 before soaking |
| 11 | example 7 after soaking |
| 12 | example 8 before soaking |
| 13 | example 8 after soaking |
| 14 | example 9 before soaking |
| 15 | example 9 after soaking |
| 16 | example 10 before soaking |
| 17 | example 10 after soaking |
| 18 | example 11 before soaking |
| 19 | example 11 after soaking |
| 20 | example 12 before soaking |
| 21 | example 12 after soaking |

TABLE 4-continued

| FIGURE | DESCRIPTION |
|---|---|
| 22 | example 13 before soaking |
| 23 | example 13 after soaking |
| 24 | example 14 before soaking |
| 25 | example 14 after soaking |
| 26 | example 15 before soaking |
| 27 | example 15 after soaking |

Having thus described the preferred embodiments of the present invention, those of skill in the art will readily appreciate that yet other embodiments may be made and used within the scope of the claims hereto attached. Numerous advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The invention's scope is, of course, defined in the language in which the appended claims are expressed.

What is claimed is:

1. Inkjet receptive media, comprising;

a synthetic organic or inorganic substrate defining a plurality of pores;

a coating overlaying at least a portion of the substrate; and the coating comprising a plurality of organic particles wherein the organic particles comprise hydrophilic polymers selected from the group consisting of crosslinked homopolymers and copolymers of N-vinyllactams, homopolymers and copolymers of N-vinylimidizoles, copolymers of polyvinylpyridine, and combinations thereof, and a plurality of inorganic particles, wherein the ratio of organic particles to inorganic particles is between about 50:50 and about 20:80.

2. The inkjet receptive media of claim 1, wherein the ratio of organic particles to inorganic particles is between about 40:60 and about 25:75.

3. The inkjet receptive media of claim 1, wherein the organic substrate comprises organic fibers and wherein the fibers are spunbonded.

4. The inkjet receptive media of claim 3, wherein the fibers comprise a thermoplastic.

5. The inkjet receptive media of claim 1, wherein the organic particles of the coating have a mean diameter of between about 0.10 micrometer and about 500.0 micrometers.

6. The inkjet receptive media of claim 1, wherein the organic particles of the coating have a mean diameter of between about 0.5 micrometer and about 200.0 micrometers.

7. The inkjet receptive media of claim 1, wherein the organic particles of the coating have a mean diameter of between about 1.0 micrometer and about 100.0 micrometers.

8. The inkjet receptive media of claim 1, wherein the substrate includes a plurality of pores having a mean diameter greater than 5 nanometers.

9. The inkjet receptive media of claim 1, wherein the inorganic particles comprise silicon oxide.

10. The inkjet receptive media of claim 1, wherein the inorganic particles comprise aluminum oxide.

11. The inkjet receptive media of claim 1, wherein the organic particles comprise poly(N-vinyllactams).

12. The inkjet receptive media of claim 1, wherein the organic particles have an ink absorbing capacity.

13. The inkjet receptive media of claim 1, wherein the organic particles have a water absorbing capacity of between 40 ml/g and 0.1 ml/g.

14. The inkjet receptive media of claim 1, wherein the organic particles have a water absorbing capacity of between 20 ml/g and 0.2 ml/g.

15. The inkjet receptive media of claim 1, wherein the organic particles have a water absorbing capacity of between 10 ml/g and 0.5 ml/g.

16. The inkjet receptive media of claim 1, wherein the coating has a weight of between about 1 $g/m^2$ and about 300 $g/m^2$.

17. The inkjet receptive media of claim 1, wherein the coating has a weight of between about 3 $g/m^2$ and about 200 $g/m^2$.

18. The inkjet receptive media of claim 1, wherein the coating has a weight of between about 5 $g/m^2$ and about 100 $g/m^2$.

19. The inkjet receptive media of claim 1, wherein the coating includes a binder.

20. The inkjet receptive media of claim 19, wherein the coating comprises less than 80% binder by weight.

21. The inkjet receptive media of claim 19, wherein the coating comprises less than 60% binder by weight.

22. The inkjet receptive media of claim 19, wherein the coating comprises less than 40% binder by weight.

23. The inkjet receptive media of claim 19, wherein the binder comprises a polyvinyl alcohol.

24. The inkjet receptive media of claim 19, wherein the binder comprises an acrylic polymer.

25. The inkjet receptive media of claim 19, wherein the binder comprises an ethylene-vinyl acetate copolymer.

26. Inkjet receptive media, comprising:

a synthetic organic or inorganic substrate defining a plurality of pores;

a coating overlaying at least a portion of the substrate; and the coating comprising a plurality of organic particles wherein the organic particles comprise hydrophilic polymers selected from the group consisting of crosslinked homopolymers and copolymers of N-vinyllactams, homopolymers and copolymers of N-vinylimidizoles, copolymers of polyvinylpyridine, and combinations thereof, and a binder comprising an acrylic polymer or an ethylene-vinyl acetate copolymer.

* * * * *

UNITED STATES PATENT AND TRADEMARK OFFICE

CERTIFICATE OF CORRECTION

PATENT NO. : 6,979,480 B1
APPLICATION NO. : 09/591075
DATED : December 27, 2005
INVENTOR(S) : Mark F. Schulz It is certified that error appears in the above-identified patent and that said Letters Patent is hereby corrected as shown below:

Title page,
Item (56), References Cited, U.S. PATENT DOCUMENTS, below "4,833,172 A" insert -- 4,861,230 A * 1/1999 Lambert et al. . . . . .430/202 --.
Item (56), References Cited, FOREIGN PATENT DOCUMENTS, below "WO WO 00/00352", insert -- EP 436230 * 10/1991 --.
Item (56), References Cited, FOREIGN PATENT DOCUMENTS, below "WO WO 00/00352", insert -- EP 914862 * 12/1999 --.

Column 1,
Line 18, delete "modem" and insert in place thereof -- modern --.

Column 6,
Line 44, delete "polyplefins" and insert in place thereof -- polyolefins --.

Column 12,
Line 1 – 2, delete "Hydroxypropylmethylcelluose" and insert in place thereof -- Hydroxypropylmethylcellulose --.

Column 18,
Line 25, delete "comprising;" and insert in place thereof -- comprising: --.

Signed and Sealed this

Eighteenth Day of September, 2007

JON W. DUDAS
*Director of the United States Patent and Trademark Office*